United States Patent [19]

Miller

[11] Patent Number: 4,710,271

[45] Date of Patent: Dec. 1, 1987

[54] BELT AND DRUM-TYPE PRESS

[75] Inventor: Ray R. Miller, 8816 Warren Dr., NW., Gig Harbor, Wash. 98335

[73] Assignees: Ray R. Miller, Geg Harbor; Weyerhaeuser Co., Tacoma, both of Wash.; a part interest

[21] Appl. No.: 849,931

[22] Filed: Apr. 8, 1986

[51] Int. Cl.[4] ..... D21F 3/00; D21F 5/02; F26B 13/18

[52] U.S. Cl. ..... 162/360.1; 34/116; 34/123; 100/93 RP; 100/153; 162/359; 165/90

[58] Field of Search ..... 162/359, 360.1, 361, 162/206; 165/89, 90; 432/60, 228; 34/116, 124, 123, 119, 125, 108; 29/110, 121.1; 100/93 RP, 153, 154; 162/358

[56] References Cited

U.S. PATENT DOCUMENTS

| | | | |
|---|---|---|---|
| 1,453,113 | 4/1923 | Hutchins | 34/125 |
| 3,110,612 | 11/1963 | Gottwald | 117/64 |
| 3,319,352 | 5/1967 | Haigh | 34/123 |
| 3,354,035 | 11/1967 | Gottwald | 162/206 |
| 3,581,812 | 6/1971 | Fleissner | 165/89 |
| 3,799,052 | 3/1973 | Kusters et al. | 100/93 RP |
| 3,838,734 | 10/1974 | Kilmartin | 165/90 |
| 3,891,376 | 6/1975 | Gersbeck | 425/373 |
| 3,938,927 | 2/1976 | Brinkmann | 425/373 |
| 3,973,483 | 8/1976 | Appenzeller | 100/93 RP |
| 4,090,553 | 5/1978 | Beghin | 164/448 |
| 4,100,683 | 7/1978 | Barp et al. | 34/125 |
| 4,194,947 | 3/1980 | Huostila et al. | 162/207 |
| 4,252,184 | 2/1981 | Appel | 165/90 |
| 4,254,561 | 3/1981 | Schiel | 34/124 |
| 4,261,112 | 4/1981 | Apitz | 432/228 |
| 4,324,613 | 4/1982 | Wahren | 162/111 |
| 4,359,827 | 11/1982 | Thomas | 34/16 |
| 4,359,828 | 11/1982 | Thomas | 34/114 |
| 4,366,025 | 12/1982 | Gordon, Jr. et al. | 29/121.1 |
| 4,440,214 | 4/1984 | Wedel | 165/90 |
| 4,457,683 | 7/1984 | Gerhardt | 425/373 |
| 4,461,095 | 7/1984 | Lehtinen | 34/41 |
| 4,596,633 | 6/1986 | Attwood | 162/206 |

FOREIGN PATENT DOCUMENTS

| | | | |
|---|---|---|---|
| 8501969 | 5/1985 | PCT Int'l Appl. | 34/108 |
| 2165349A | 4/1986 | United Kingdom . | |

OTHER PUBLICATIONS

MacDonald et al, "Papermaking and Paperboard Making", 2nd edition, vol. III, 1970, p. 419.

"HI-I Press, Mark III Installed at Scott Paper, Mobile", Pulp and Paper Magazine of Canada, Nov. 15, 1968, pp. 56–57.

*Primary Examiner*—S. Leon Bashore
*Assistant Examiner*—K. M. Hastings
*Attorney, Agent, or Firm*—Keith D. Gehr; John M. Crawford

[57] ABSTRACT

A press belt arrangement in which none of the compressive forces on the central drum are transmitted to the supporting frame. It provides a method in which a greater compressive force in relationship to belt tension is applied to the drum. The invention makes it possible to construct the central drum so that large quantities of heat can be fluxed through it for purposes of achieving the fast drying rates long sought in the industry.

21 Claims, 59 Drawing Figures

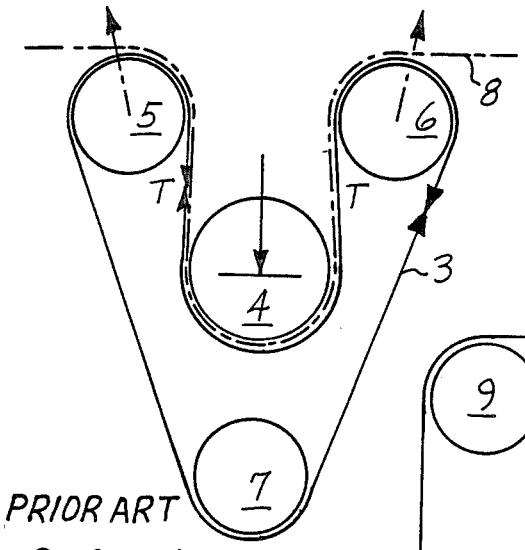
PRIOR ART
Fig. 1
Fig. 2
PRIOR ART
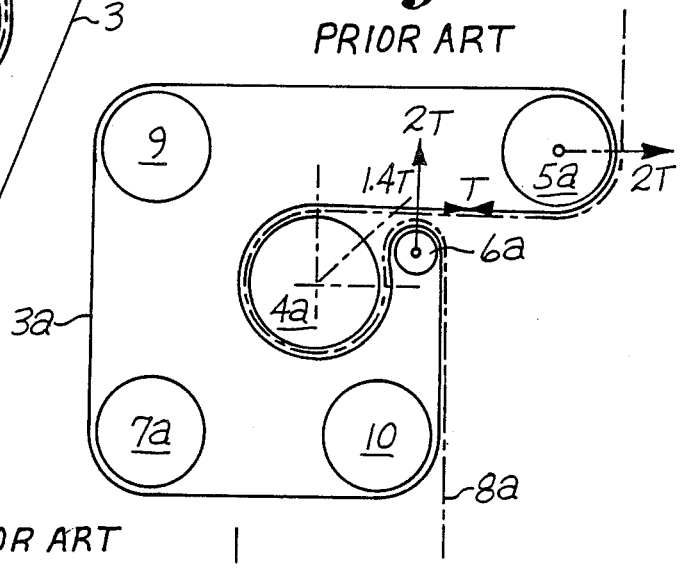
Fig. 3 PRIOR ART
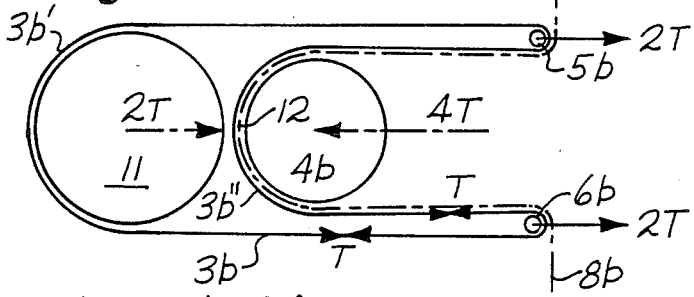
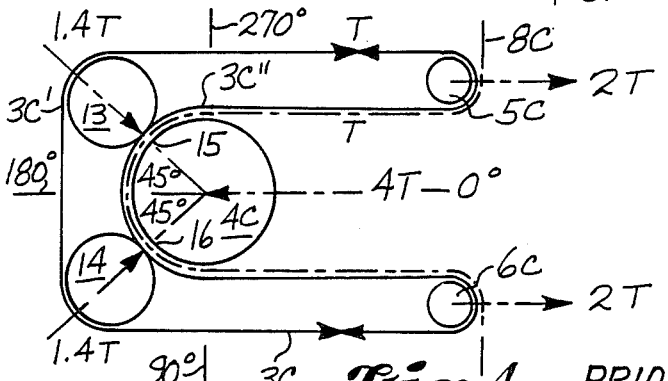
Fig. 4 PRIOR ART Fig.5
PRIOR ART
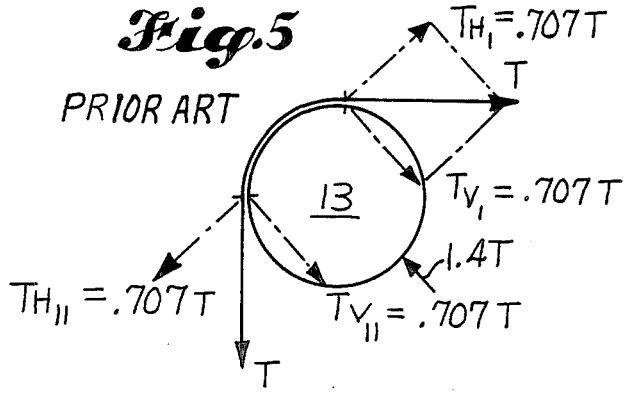
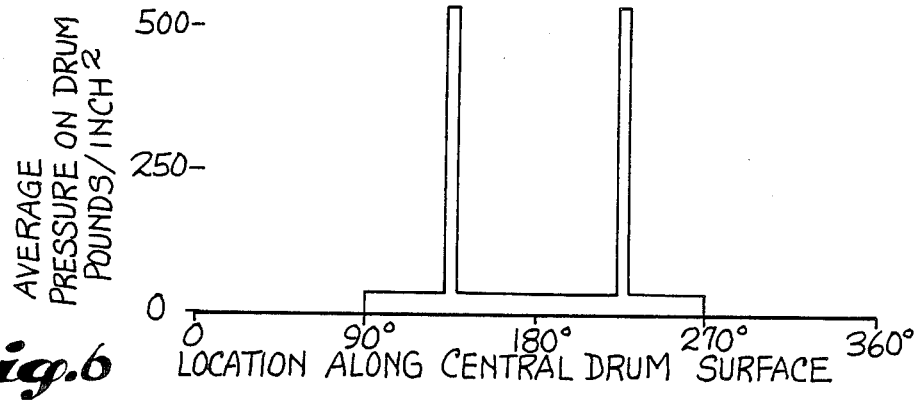
Fig.6
PRIOR ART
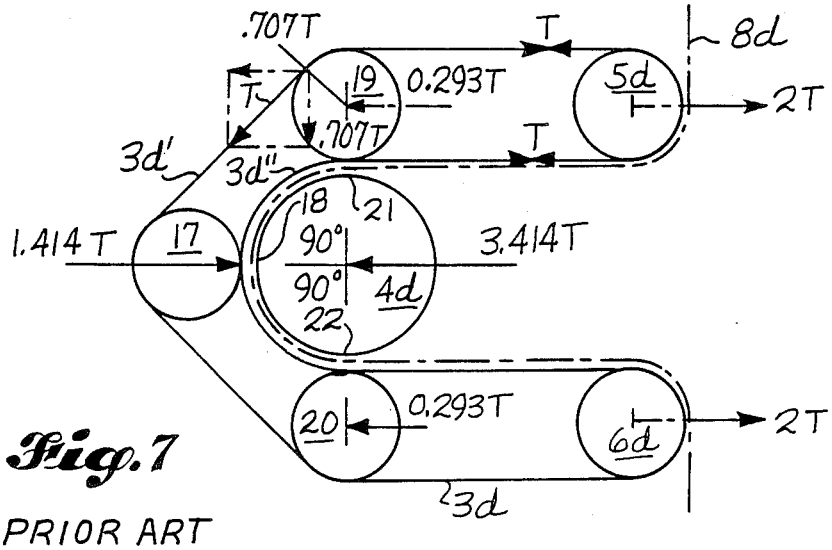
Fig.7
PRIOR ART Fig. 39
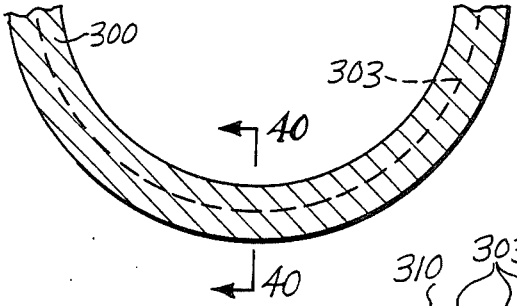
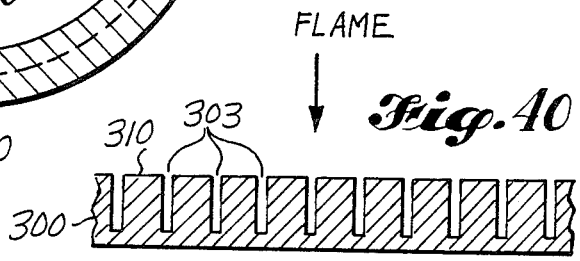
Fig. 40
Fig. 41
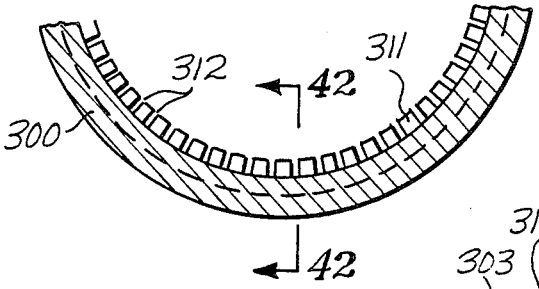
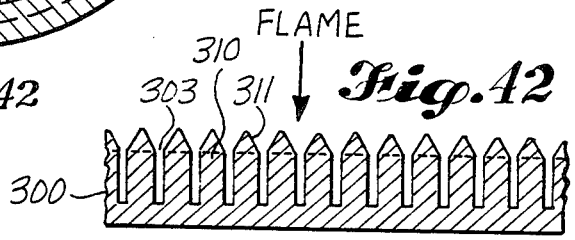
Fig. 42
Fig. 43
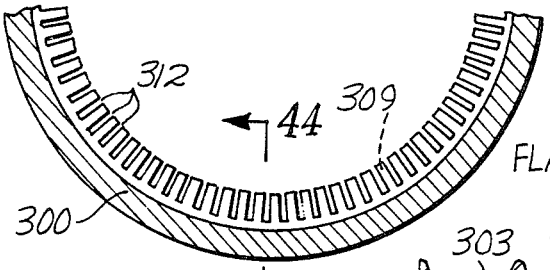
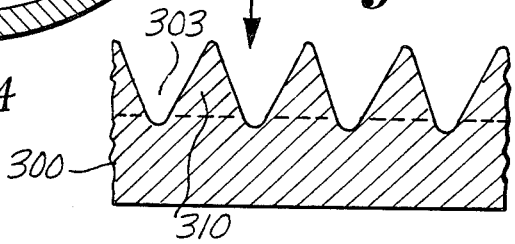
Fig. 44

Fig. 58
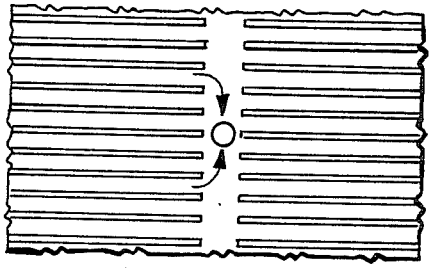
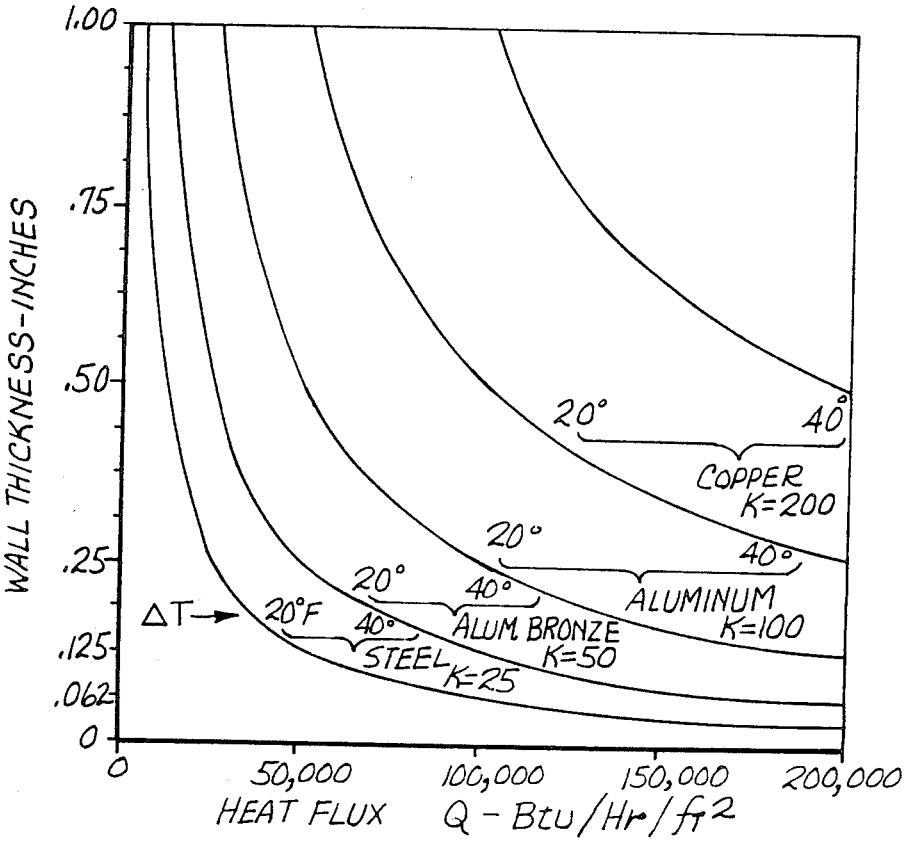
THERMAL/CONDUCTIVITY K - Btu/[Hr(ft2/ft)°F]
COPPER K= 200 APPROX.
ALUMINUM = 100 APPROX.
ALUM. BRONZE= 50 APPROX.
STEEL = 25 APPROX.
Fig. 59

BELT AND DRUM-TYPE PRESS

BACKGROUND OF THE INVENTION

1. Technical Field

This invention relates to an apparatus and technique for compressing a moving web with an endless flexible belt, and particularly an apparatus and technique of this nature wherein the web is compressed by the belt while the web is guided about the heated cylindrical surface of a rotatable drum. It also relates to a heated drum which is particularly useful in this connection.

2. Background Art

Presses are used to consolidate paper and panel products. Examples of this consolidation are the formation of a pulp mat from a pulp slurry, the formation of paper from wood pulp or other fibrous material, or the formation of a panel product from wood particles or flakes. Compressive forces act on and consolidate the material as it passes through the nip formed by a pair of rolls. The greater the compressive force the greater the consolidation.

The compressive forces at the nip perform another function in the formation of paper—the removal of water from the web.

The compressive forces acting on a web in the nip between the two rolls is of short duration. The time that the compressive force may act on the web may be extended by the use of a belt press. In a belt press a belt is wrapped around a section of the periphery of a drum and exerts a compressive force on a web passing between the belt and drum. Tension in the belt is translated into a compressive force on the web and drum. Belt presses are used both for paper and for panel products. Gottwald et al, U.S. Pat. Nos. 3,110,612 and 3,354,035 and Haigh, U.S. Pat. No. 3,319,352 are exemplary of belt presses for paper. Gersbeck et al, U.S. Pat. No. 3,891,376, Brinkmann et al, U.S. Pat. No. 3,938,927 and Gerhardt et al, U.S. Pat. No. 4,457,683 are exemplary of belt presses for panel products.

FIGS. 1–10 illustrate compressive forces from belts and nips acting on a web. These figures also illustrate the forces that are being passed to the frame of the apparatus. In the illustrations of the compressive forces on the web in both the background section and the detailed description section a number of parameters are held constant. These are:

(a) The belt tension (T), (b) The belt materials, (c) The conditions in the nip, e.g., web thickness, roll covering, etc., (d) The constant surface temperature of the drum, and (e) The forces due the rotational drive forces and the component weight.

In addition, relative roller diameters and belt angles are arbitrarily selected to simplify analysis. The diameter and belt angle options are infinite but the arbitrary selection will not greatly distort the illustration. Also, supplemental nip forces mentioned often in the art are not taken into account in the examples.

The only variable being analyzed is the total compressive force (TCF) produced by belt tension or directly by belt tensioning forces available to compress the web being processed. These forces are expressed as a multiple of belt tension T. Both T and TCF may be expressed in suitable force units such as pounds.

There are three categories of compressive force acting on the web. These are:

(1) The total compressive force radial to the central drum caused by that portion of the belt resting directly on the central drum and due to tension in that portion of the belt only. This quantity is equal to:

$$T2\pi \text{ (\%of central drum circumference contacted/100)}$$

(2) The nip force of each of the belt tension rollers when these rollers make a nip with the central drum.

(3) The nip force of each of the belt carrying idler rollers other than the tension rollers upon the central drum when these rollers make a nip with the central drum. The force is created by the belt tension only.

FIGS. 1–10 are representative of prior art drum and belt presses.

FIG. 1 illustrates the configuration shown in FIG. 1 of Gottwald et al, U.S. Pat. Nos. 3,110,612 and 3,354,035. FIG. 2 illustrates the configuration described in line 25 of column 4 of Gottwald et al, U.S. Pat. No. 3,110,612. In both of these figures the total compressive force is created solely by the belt resting on the central drum. There is no nip force on the central drum.

In FIG. 1 the belt 3 circumferentially contacts 180° or 50% of the surface of central drum 4. The tension T on the belt is provided by the two tensioning rollers 5 and 6. The idler roller 7 holds the inner and outer courses of belt 3 apart. The web 8 is guided around the central drum 4 and pressed against the central drum 4 by the belt 3. The total compressive force on the central drum 4 and web 8 is equal to 3.14 T. The tensioning rollers 5 and 6 are attached to a frame and the tension of approximately 2 T is transferred to the frame from each roller. In addition, there is an axial bending force of 2 T on the central shaft of the central drum 4. There is also an axial bending force of approximately 2 T on each of the central shafts of tensioning rollers 5 and 6 and idler roller 7. The central drum 4, the tensioning rollers 5 and 6, and the idler roller 7 are all attached to the frame and the forces upon them are transmitted to the frame. Neither the tensioning rollers 5 and 6 nor the idler roller 7 from a nip with the central drum 4.

In FIG. 2 the belt **3*a* circumferentially contacts 270° or 75% of the surface of central drum 4*a*. The tensioning rollers are 5*a* and 6*a* and the idler rollers are 7*a*, 9 and 10. The web 8*a* is guided around the central drum 4*a* and pressed against the central drum 4*a* by the belt 3*a*. The total compressive force acting on the central drum 4*a* and the web 8*a* is 4.7 T. Again, there is an axial bending force applied to the central shaft of central drum 4*a* and an axial bending force applied to each of the tensioning rollers 5*a* and 6*a* and idler rollers 7*a*, 9 and 10**. These forces are passed on to the frame for the apparatus and the frame must be strong enough to carry them.

Haigh, U.S. Pat. No. 3,319,352; Gersbeck et al, U.S. Pat. No. 3,891,376; and Brinkmann et al, U.S. Pat. No. 3,938,927 are exemplary of configurations in which one or more idler nip rolls are used.

In each of the following examples the total compressive force caused by the belt on the central drum will be the same as those calculated for FIGS. 1 and 2—3.14 T at 50% circumferential contact between the central drum and the belt.

FIG. 3 illustrates a configuration in which there is one idler nip roll. The belt **3*b* and the web 8*b*** circumferentially contacts 50% of the surface of the central drum 4b. The tensioning rollers are 5b and 6b. An idler nip roller 11 is within the belt 3b and forced toward central drum 4b by the outer course 3b' of belt 3b and forms a nip 12 with the central drum 4b. The web 8b is guided around and pressed against the central drum 4b by the inner course 3b'' of belt 3b. The idler roller 11 also compresses the belt 3b and web 8b in the nip 12. The compressive force in nip 12 is 2 T. The total compressive forces—idler roller nip force and belt force—are 5.4 T. There will also be 4 T of axial bending force acting upon the central drum 4b and 2 T of axial bending force acting on each of the tensioning rollers 5b and 6b. These forces are transferred to the frame of the apparatus.

FIG. 4 illustrates a configuration in which there are two idler nip rollers. The belt 3c and web 8c train around 50% of the surface area of central drum 4c and the belt 3c is held in tension by tensioning rollers 5c and 6c. A pair of idler nip rollers 13 and 14 are within belt 3c and are placed at a 45° angle to the axis of central drum 4c. The idler nip rollers 13 and 14 are forced toward central drum 4c by the outer course 3c' of belt 3c and form nips 15 and 16 with the central drum 4c. The web 8c is guided around and pressed against the central drum 4c by the inner course 3c'' of belt 3c. A vector analysis of the forces acting upon each of the idler nip rollers is shown in FIG. 5. Roller 13 is illustrated. The resultant compressive force is 1.4 T in each of the nips 15 and 16. The total compressive forces acting on web 8c—the belt compressive force and the nip compressive force—are 5.94 T. The axial bending forces of 2 T on each of the tensioning rollers 5c and 6c, and 4 T on central drum 4c are transferred to the frame.

FIG. 6 illustrates the system shown in FIG. 4 and the average pressures acting on the central drum 4c and the web 8c at various locations around the drum. For purposes of illustration the following parameters were chosen—1,000 pounds per lineal inch (pli) belt tension and a 50 inch drum diameter. This results in a compressive force from the belt of 40 pounds per square inch (psi). An average nip pressure of 500 psi is assumed. The belt pressure is continuous over 50% of the drum surface and the nip pressure is discontinuous as shown.

FIG. 7 illustrates a configuration in which there are three idler nip rollers, central idler nip roller 17 and side idler nip rollers 19 and 20. The idler nip rollers 17, 19 and 20 are forced toward central drum 4d by the outer course 3d' of belt 3d to form nips 18, 21 and 22 with the central drum 4d. The web 8d is guided around and pressed against central drum 4d by the inner course 3d'' of belt 3d. The forces acting on central idler roller 17 are the same as those shown for idler roller 13 in FIG. 5. The compressive force acting on the web 8d in the nip 18 is 1.4 T. A vector diagram of forces acting on side idler rollers 19 and 20 is shown in FIG. 7. The compressive force acting on the web 8d in each of the nips 21 and 22 is 0.7 T. The total compressive forces acting on the web 8d are 5.94 T. The axial bending forces of 2 T on each of the tensioning rollers 5d and 6d, 3.414 T on central drum 4d and 0.29 T on each of the side idler rollers 19 and 20 are transferred to the frame.

FIG. 8 illustrates a configuration in which there are four idler nip rollers, central idler nip rollers 23 and 24 and side idler nip rollers 27 and 28. The idler nip rollers 23, 24, 27 and 28 are forced toward central drum 4e by the outer course 3e' of belt 3e to form nips 25, 26, 29 and 30 with the central drum 4e. The web 8e is guided around and compressed against central drum 4e by the inner course 3e'' of belt 3e. A vector diagram of forces acting on central idler nip rollers 24 and 25 is shown in FIG. 9. Central idler nip roller 24 is illustrated. The compressive force acting on the web 8e in each of the nips 25 and 26 is T. The compressive force acting on the web 8e in each of the nips 29 and 30 is shown in FIG. 8. It is 0.5 T. The total compressive forces acting on the web 8e during its travel around the central drum 4e are 6.14 T. Again the axial bending forces acting on the central drum 4e, the tensioning rollers 5e and 6e, and the idler nip rollers 23, 24, 27 and 28 are transferred to the frame.

FIG. 10 illustrates a configuration in which there is a large number of idler nip rollers. In this configuration the idler nip rollers 30 extend throughout the area of belt and web contact with the central drum 4f. The idler nip rollers 31 are forced toward central drum 4f by the outer course 3f' of belt 3f to form nips 31 with the central drum 4f. Two belt and web guide rollers 32 and 33 are added. The web 8f is guided around and compressed against central drum 4f by the inner course 3f'' of belt 3f. In this configuration the total compressive forces acting on the web through the nips of the idler nip rollers are approximately equal to the total compressive forces from the belt. The total compressive forces acting on the web will be 6.28 T. The axial bending forces on the tensioning rollers 5f and 6f, and the central drum 4f are transmitted to the frame.

In each of the above belt loop configurations, forces from the belt and roller system are carried by the frame. In each of these configurations, the central drum must be mounted on the frame and the unbalanced compressive force on the shaft of the central drum, and on the shafts of the tensioning and some idler rollers is passed to the frame. The unbalanced compressive forces acting on the shafts and on the frame range from 1.57 T to 4 T. The central drum is heavy and the shell is thick in order to absorb these forces with allowable bending stress.

If the press is used as a dryer, then the drum will usually be heated. U.S. Pat. No. 4,324,613 discloses a pair of nip rolls for consolidating and drying paper in which one of the rolls is a heated drum. In belt presses, the belt may wrap around a heated drum. The Gottwald et al, Haigh, Gersbeck et al, Brinkmann and Gerhardt et al patents disclose a heated central drum. In conventional practice, the thickness of the shell of the central drum would severely limit the rate of transfer of heat through the shell to the web.

Heat transfer drums are described in Fleissner et al, U.S. Pat. No. 3,581,812; Kilmartin, U.S. Pat. No. 3,838,734; and Beghin, U.S. Pat. No. 4,090,553; Heisterkamp, U.S. Pat. No. 3,237,685; Cappel et al, U.S. Pat. No. 4,183,298; Appel, U.S. Pat. No. 4,252,184; Schiel, U.S. Pat. No. 4,254,561 and Wedel, U.S. Pat. 4,440,214. A press having a free floating high pressure nip roll is described in "HI-I Press, Mark III Installed At Scott Paper, Mobile;" Pulp and Paper Magazine of Canada, Nov. 15, 1968, pages 56-57.

The attainable speed for drying paper is often limited by the need to maintain web integrity during the forming and drying process. At high moisture contents the web is held together by water viscosity, surface tension, and the fiber contact sites. As the web is dried, the influence of viscosity and surface tension decreases both because there is less water and because viscosity and surface tension decrease with an increase in temperature; and the influence of bonding sites increases. The web will actually lose strength as it is initially heated in the dryer. This is seen in FIG. 11 which illustrates the passage of a web of paper through the forming, pressing and drying section of a paper machine and shows the change in strength characteristics of the paper web through the machine as the sheet dries. FIG. 12 is a similar figure for newsprint. It shows the breaking length and web strength characteristics of a web of newsprint as it passes through the pressing and drying operation. FIG. 12 is from Thomas, U.S. Pat. No. 4,359,827 and 4,359,828 and the phenomenon is discussed in detail in these patents.

There are many variables which influence the degree of drying and strengthening of the web as it passes through the first drying drum and exits from the drum. There are a number of machine variables. If a belt is used to hold the web on the drum, then the tension of the belt and the diameter of the drum are factors. If a felt is used, the permeability of the felt is a factor. If a pressure nip is used, then the pressure in the nip, the residence time in the nip and the ventilation from the nip are factors. The machine speed, the tension on the web being drawn through the machine, the temperature of the heating drum and the heat recovery rate of the drum are also factors. There are also a number of variables within the web. The freeness and permeability of the web, the compressibility of the web, the bondability of the web, the dryness or moisture content of the web as it reaches the drum, the temperature of the web, and the weight and thickness of the paper or paperboard are all factors. The tendency of the web to stick to the drum is also a factor. The limiting speed in a given situation will depend on a combination of all of the above factors. A given machine will have a maximum speed for a given web or a given web will require a certain drying capacity to achieve a given speed. The operation of the machine at a capacity below the limits influenced by these various factors is not possible.

Attempting to remove moisture from the web quickly in order to accelerate the initial heating also creates a problem. If moisture vapor in the web creates interior pressure much above constraining pressures, then the internal expansion of the vapor in the web will tend to blow the web apart.

The approximate maximum machine speeds for linerboard are shown in FIG. 13. These are examples of commercial speeds for drying paper. FIG. 13 is a plot for the drying of unbleached kraft linerboard and shows machine speed in feet per minute against grade weight in pounds per thousands square feet of web. Line 40, the dotted line, indicates the possible machine speeds versus grade weights at a constant production rate of 6.75 tons per day per inch of machine width. Line 41, the solid line, shows the actual approximate maximum commercial speed at various grade weights. These speeds correspond to a production rate in tons/day/lineal inch of machine width of 3.6 at a grade weight of 26 lb/1000 $ft^2$, 5.3 at 42 lb/1000 $ft^2$, 6.8 at 69 lb/1000 $ft^2$, and 5.1 at 90 lb/1000 $ft^2$.

Commercial linerboard machines use 1,500–2,000 lineal circumferential feet of dryer to operate at these speeds. The dryer drum temperatures will range from 212° F. to 400° F. and web pressures on the drum are typically up to 1–2 lb/$in^2$ (psi). Water removal rates are on the order of 5–7 pounds per hour per square foot of drum. For some paper grades, such as tissue, a relatively high pressure nip with the drum is made to iron the wet web onto the drum.

SUMMARY OF THE INVENTION

Throughout the application, the term belt may include a belt and felt assembly.

The present invention relates to a belt press and a belt press dryer which allows greater forces from belt tension to be placed on the web passing through the press. The construction also causes balanced forces to be placed on the central drum allowing a lighter drum shell and dryer drum construction. In heated drums this lighter construction allows heat to be passed more quickly to the web. The construction also removes forces from the surrounding structure allowing a more economical structure. The construction also allows a new method of press drying.

In the present invention, the U-shaped inner course of an endless belt is wrapped around a central drum with the outer face of the belt contacting the face of the central drum as in other belt press arrangements. A web to be treated is between the belt and the drum face and is pressed against the drum by the belt. The web may comprise various materials including plastics, fabrics, wood chips or flakes, and paper making stock. Appropriate binder and coating materials may be included. The belt tension is applied by two tensioning rollers placed within the endless belt and contacting the inner face of the belt. The tensioning rollers are located in the end loops formed at the junction of the inner and outer courses of the endless belt.

The axes of the two tensioning rollers can be biased toward and away from each other to adjust the tension on the belt. The shafts of the tensioning rollers are connected by the tensioning linkages. The press has means for moving the tensioning rollers relatively toward one another in engagement with the end loops of the endless belt. The movement of the tensioning rollers causes the tensioning rollers to form nips with the central drum. The belt and the web are compressed between the tensioning rollers and the central drum at their nips. The inner course of the belt between the tensioning roller nips clasps the central drum and web. The overall forces operating against the central drum are intrinsically balanced. The total compressive forces acting on the web due to belt tension, and belt tensioning forces are increased relative to the compressive forces of similar but unbalanced arrangements without supplemental force application.

There may be additional idler nip rollers within the belt between the inner and outer belt courses and between the two tensioning rollers. The number of idler nip rollers is a matter of choice. The limits of relative diameters of the central drum and the tensioning and idler rollers will depend upon the number of rollers. There must be more than two tensioning and idler rollers if the central drum has a diameter greater than that of the rollers.

Each of the additional idler nip rollers is mounted to be movable generally radially inwardly and outwardly toward and away from the central drum with the inward radial force being supplied by the belt tension as the belt is tensioned about the central drum. Each of the additional idler nip rollers also is fixed angularly with respect to the central drum. The adjustment of the two tensioning rollers adjusts the tension in the belt which causes all of the rollers to apply more or less pressure on the inner course of the belt, the web and the central drum.

Moving the tensioning rollers toward each other increases the tension in the belt and causes both the inner and outer courses of the belt to move inwardly toward the central drum. This inward movement will cause the inner belt course to apply greater compressive force against the web and the face of the central drum. This inward movement will also cause the outer belt course to apply greater force against the idler nip rollers, causing them to move toward the central drum and increase the compressive force at the nips of each of the idler nip rollers acting on the inner course of the belt, the web and the central drum. This inward movement will increase the total compressive forces acting on the web and central drum at the nips between the tensioning rollers and the central drum. Moving the tensioning rollers away from each other will decrease the belt tension and the various compressive forces.

The tensioning roller arrangement allows both greater belt forces on the drum because of the inherent ease of greater circumferential contact between the belt and the central drum and greater nip forces because of the tensioning roller nips. The tensioning roller arrangement also allows the overall forces operating against the central drum - the belt force and nip forces on the drum due to belt tension and belt tensioning forces - to be intrinsically balanced at all values of belt tension. There are no forces due to belt tension transmitted to the supporting structure. There are no axial bending forces on the central drum. Neither are there axial bending forces on the idler nip rollers because each of these rollers is placed around and against the central drum and each of the idler nip rollers is placed in a position in which the entry and exit angles between the outer belt course and the radial line between the roller and the central drum are equal.

The balanced forces on the central drum and on the rollers simplify the support framework because the tensioning and bending forces no longer act on the support framework.

The balanced forces and the absence of appreciable bending forces on the central drum make it possible for the central drum to be of lighter and simpler construction which is cheaper to construct. For example, in certain embodiments of the invention the central drum takes the form of a hollow, open ended ring-like member which is of a material and has a wall thickness which will withstand the total compressive forces acting upon it. This construction allows the use of combustion within the bore of the drum as a heat source.

The outer shell can also be modified, as by slitting at its outer surface, to partially relieve the thermal stresses on the surface when heat is transferred through the outer surface of the roller. This is possible because the mechanical stresses imposed are ring crushing stress, not axial bending stresses.

The central drum can also be constructed with a thin outer shell. In this construction the central drum has an inner cylindrical body and an outer concentric cylindrical shell spaced apart radially of the inner cylindrical body to form a shallow annulus between the inner body and the outer shell. There is a system of radial connections between the outer shell and the inner body to secure one to the other. The connections are arraged about the inner body in the annulus to provide load bearing support for the outer shell over the entire area of the annulus as well as the capacity to retain the shell against internal pressure in the annulus.

The annulus may be used as a conduit for the flow of heating fluid. The outer shell would be closed and the inner body would be apertured for supply of fluid. The fluid would be removed by ducts or other means located at the ends of the annulus. It may be necessary to have additional removal sites located along the length of the annulus. These would be apertures in the inner drum body to which removal ducts are attached. In some presently preferred embodiments of the invention, for example, the drum takes the form of a hollow, open-ended ring-like member having radially oriented apertures in the inner body and duct means slip-jointed with the aperture for supplying fluid to the aperture, and duct means slip-jointed to the ends of the annulus for removing the fluid from the annulus after it circulates through the annulus from the aperture.

The annulus may have passages formed within it to carry the fluid or vapor. The connections would be spaced apart from one another to subdivide the annulus into a multiplicity of fluid flow passages which extend throughout the annulus generally axially of the drum. The connections may take the form of spaced spoke-like members. The connections could form the side walls of the passages.

The thin outer shell allows more heat per unit time to be transmitted through the shell to the material being dried or compressed on the drum. A heat transfer fluid, such as steam, would be circulated through the annulus to transfer heat to the web. The radial surfaces of the passages may be extended in relation to the circumferential passage width to increase the steam condensing area and enhance the condensing rate because the extended radial surfaces have the aid of centrifugal force in removing the condensate from the condensing surface. The heat transfer surface of the passages would be greater than the outer heat transfer surface of the shell also allowing more heat per unit time to be transmitted through the shell. Metal stress from internal steam pressure is reduced to a small value because of the small cross section of the passages relative to the wall thickness of the passages. The walls between the passages carry external mechanical loads from the outer shell to the strong inner body of the drum.

The reduction of mechanical stresses in the drum permits the use of lower strength, higher heat conductive materials such as copper in the outer shell permitting an even highe heat flux with reduced thermal stress. The use of an outer shell construction also allows the inner drum body to be constructed of stronger materials since thermal conductivity in the inner drum is no longer an issue because the heat flow path does not go through the inner drum. For example, selected grades of copper and stainless steel have essentially identical thermal expansion and could be used in combination for the outer shell and inner body of the drum.

The thinner outer shell allows greater heat transfer and consequently a smaller peripheral surface is needed to transfer the same amount of heat transferred in a conventional drying drum. The reduced drum diameter will also increase the magnitude of the uniform belt pressure on the drum which will facilitate increased heat transfer and an increased restraining force on the web. The reduced drum diameter will also decrease ring crushing stresses in the drum due to nip loads and reduce the construction cost. The reduced diameter is possible for a given heat transfer requirement both because of the increased heat flux through the drum shell and because of the increased nip loading on the drum by the tension rollers.

The tensioning rollers may also be used to support the central drum.

The rollers and the central drum are cylindrical and not crowned. The belt is normally rotated by driving one of the tensioning rollers, although any roller can be driven.

In other embodiments, the surface of the central drum can be apertured for flow of fluid to or from the web.

BRIEF DESCRIPTION OF THE DRAWINGS

FIGS. 1–4 are diagrams showing various prior art central drum, belt and roller combinations and the forces acting within these systems.

FIG. 5 is a vector analysis diagram of the forces acting on one of the idler nip rollers in FIG. 4.

FIG. 6 is a diagram showing the compressive force pattern on the drum of FIG. 4.

FIGS. 7–8 are diagrams similar to FIGS. 1–4 and showing additional combinations in the prior art of a central drum and rollers.

FIG. 39 is a portion of another drum shell.

FIG. 40 is a cross-sectional view taken along line 40—40 of FIG. 39.

FIG. 41 is a portion of another drum shell.

FIG. 42 is a cross-sectional view taken along line 42—42 of FIG. 41.

FIG. 43 is a portion of another drum shell.

FIG. 44 is a cross-sectional view taken along line 44—44 of FIG. 43.

FIGS. 55–58 are diagrams showing various fluid flow patterns in the annulus.

FIG. 59 is a graph which illustrates the relationship of heat flow, temperature drop and wall thickness for each of several metals commonly used in the construction of heat transfer media.

DETAILED DESCRIPTION OF THE PREFERRED EMBODIMENT

Figure 33:
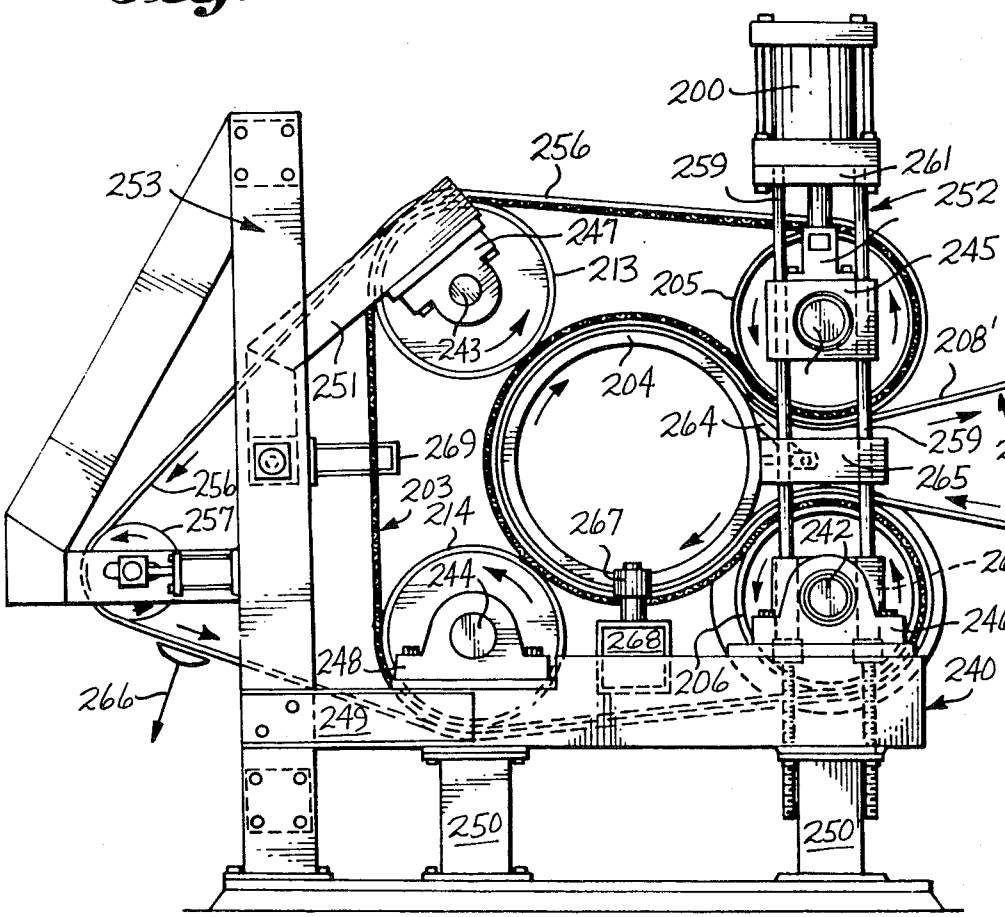
FIG. 33 is a side elevational view of a prototype unit.
Figure 35:
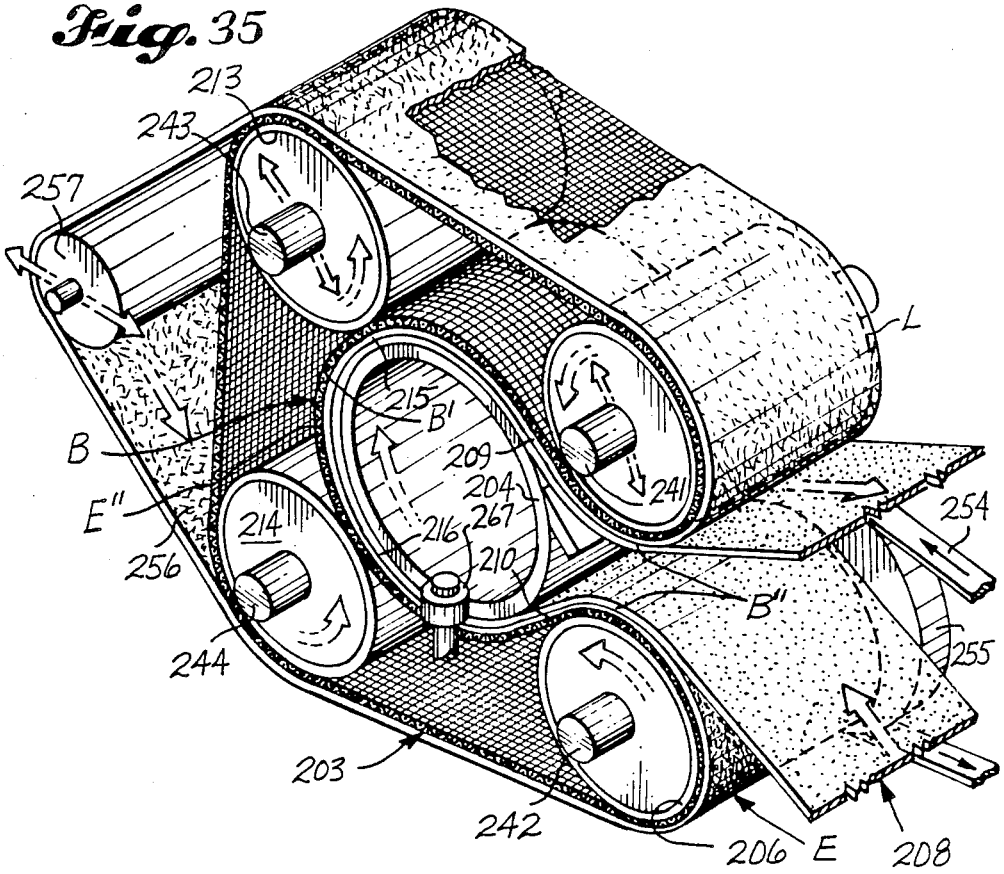
FIG. 35 is a perspective view of the belt, roller and drum assembly in the embodiment of FIGS. 33 and 34.

FIGS. 14–20 are examples of various embodiments of the invention. These systems may have any number of rollers. In each of these examples, the rollers 105 and 106 are the tensioning rollers. The drum 104 is the central drum and the means 100 is the movement means which moves rollers 105 and 106 reciprocally with respect to each other to tension or loosen the belt assembly 103. The web being pressed is 108. The felt is separately tensioned as shown in FIGS. 33 and 35. In each of the examples, one of the tensioning rollers 105 or 106 must have its position fixed, or controlled, on the support frame to define the location of the belt and roller assembly. The central drum 104 is free to move radially in order to form nips with the other rollers as determined by belt tension. Any two rollers can be used to support the weight of the belt, drum and roller assembly upon the frame. It is most convenient to have the weight borne by the two tensioning rollers 105 and 106. Any, or all, of the drum and rollers can be driven by suitable drive means.

Figure 8:
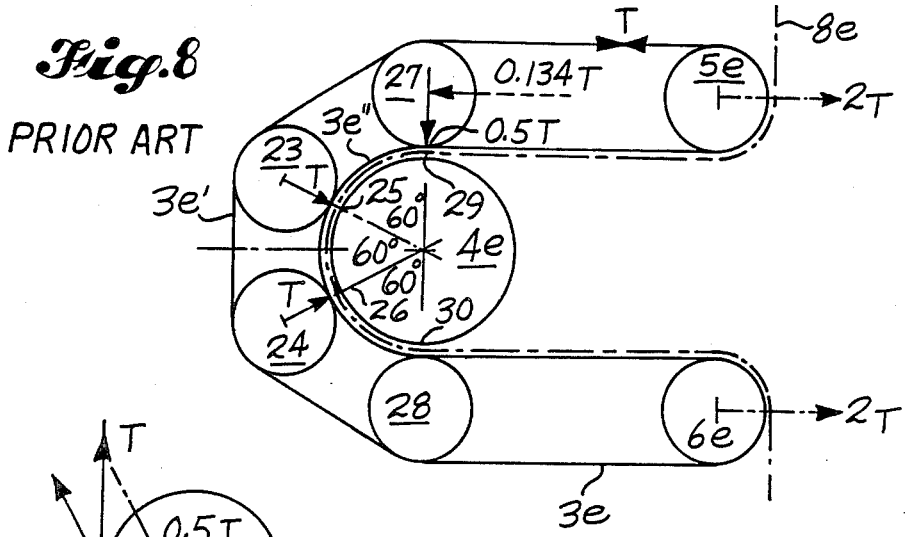
Fig.8 PRIOR ART
Figure 9:
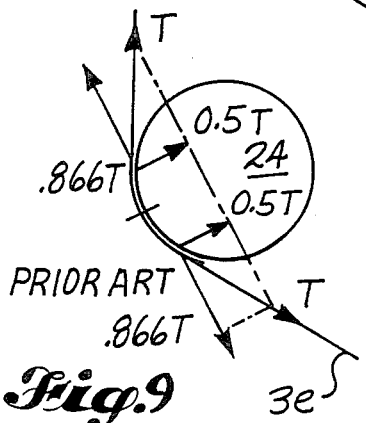
PRIOR ART Fig.9
FIG. 9 is a vector analysis diagram of the forces acting on one of the idler nip rollers in FIG. 8.
Figure 10:
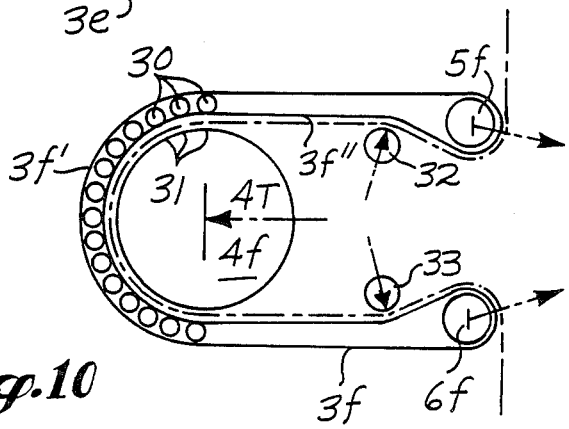
Fig.10 PRIOR ART
FIG. 10 is a diagram similar to FIGS. 1–4 showing another prior art central drum and roller combination.
Figure 13:
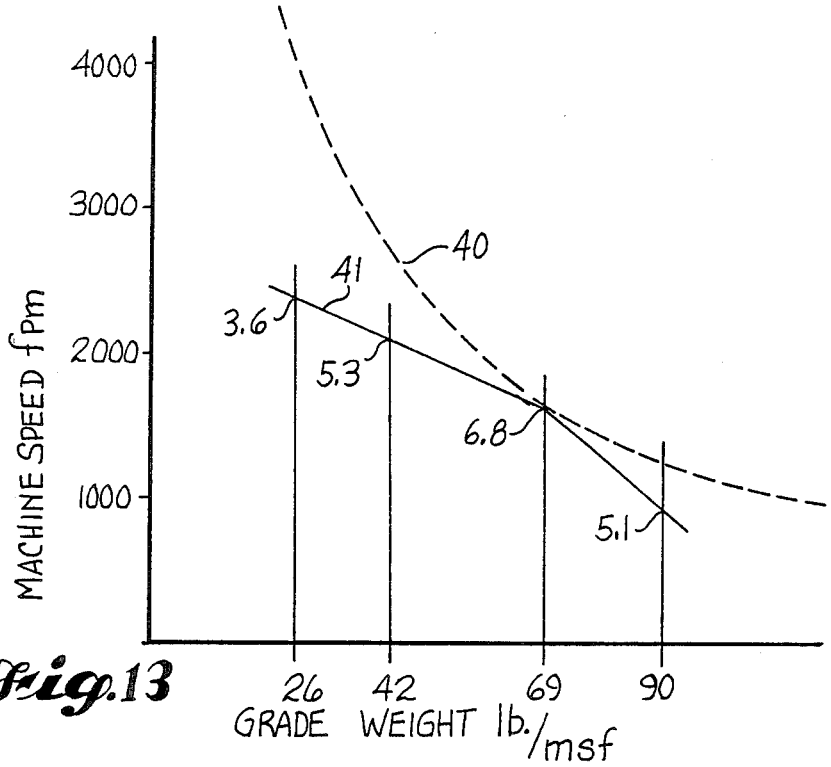
FIG. 13 is a graph of machine speed versus grade weight in linerboard manufacture.
Figure 11:
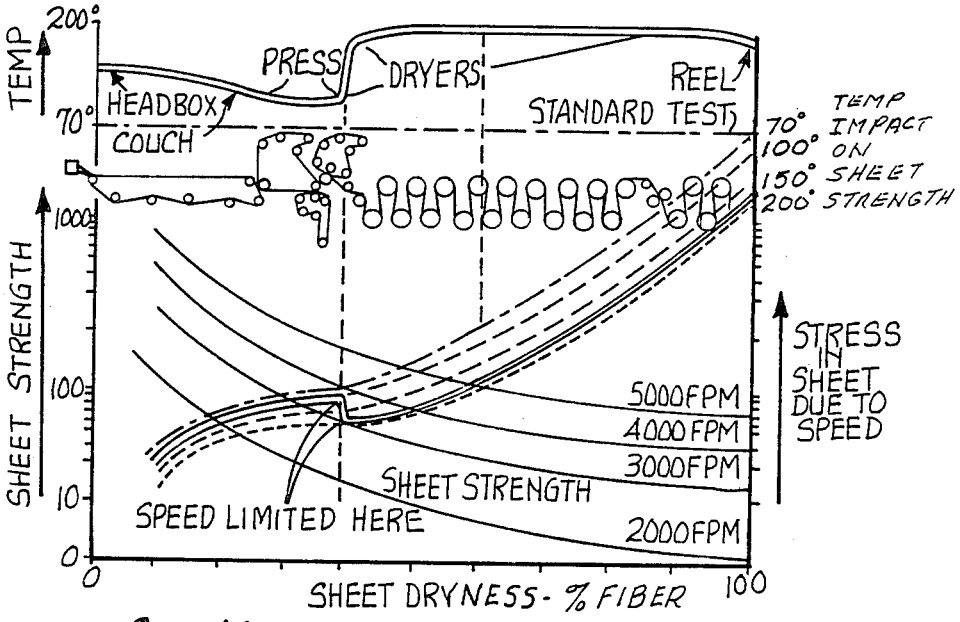
FIGS. 11 and 12 are plots showing sheet strength as the sheet is formed and carried through the press and dryers.
Figure 12:
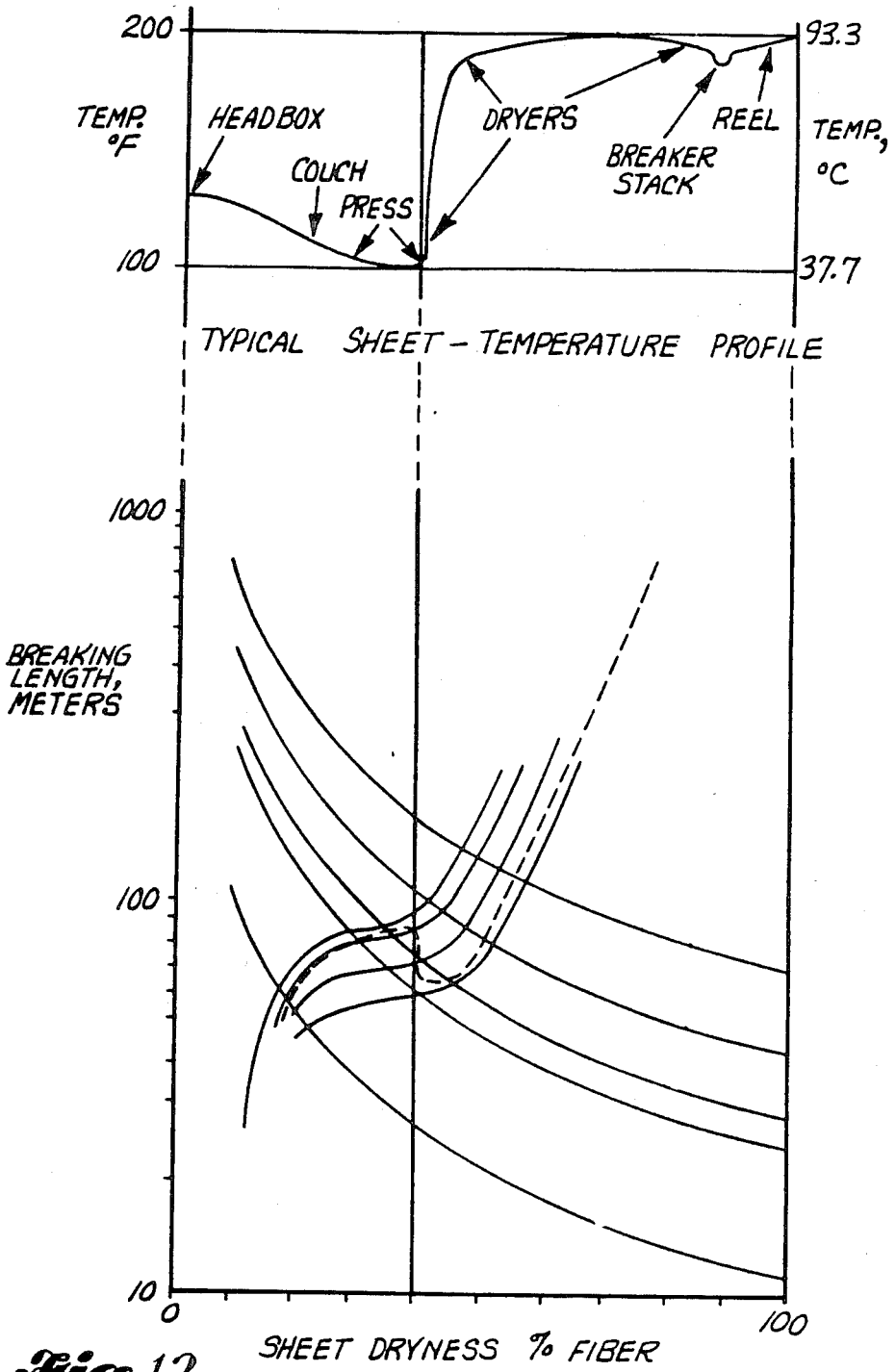
Figure 14:
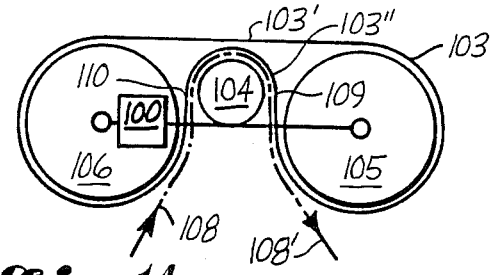
FIGS. 14–20 are schematic views of embodiments of the invention.

In FIG. 14 the belt is wrapped about a single pair of tensioning rollers 105 and 106 which are reciprocable relative to one another, to tension the belt, using movement means schematically illustrated at 100. The rollers are sufficiently oversized with respect to the central drum 104 that the axis of the central drum parallel to the plane of the axes of the tensioning rollers 105 and 106 will remain spaced apart from that plane, and the outer course 103' of the belt 103 will remain spaced apart from the U-shaped inner course 103" of the belt when the belt is tensioned by the two rollers 105 and 106. The central drum 104 is free to move radially to nip with rollers 105 and 106 at 109 and 110 to press the web 108.

Figure 15:
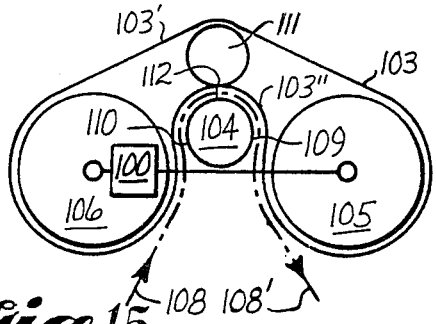

FIG. 15 illustrates the fact that a third roller 111, an idler nip roller, may be added to facilitate maintaining the appropriate spaced condition between the two courses of the belt and in increased flexibility in the choice of roller diameters. The added roller 111 is mounted to reciprocate with respect to an axis of the central drum 104, generally radially thereof, but not rotate about that axis of central drum 104. Idler nip roller 111 forms nip 112 with the central drum 104.

Figure 16:
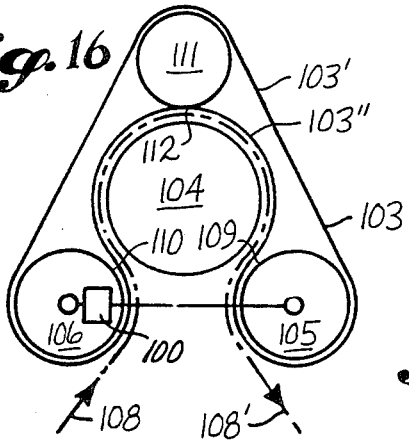

In FIG. 16 a third roller 111 is again employed, but the tensioning rollers 105 and 106 and the third roller 111 may be substantially smaller in diameter than central drum 104. This is the preferred arrangement. The assembly is supported by the tensioning rollers 105 and 106.

Figure 17:
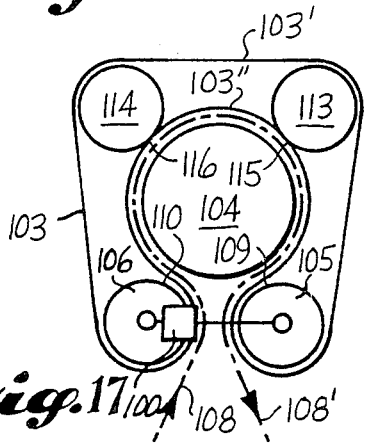

FIG. 17 illustrates a four roller arrangement. Tensioning rollers 105 and 106 support the assmbly and idler nip rollers 113 and 114 move radially with respect to central drum 104 to form nips 115 and 116 with the central drum 104.

Figure 18:
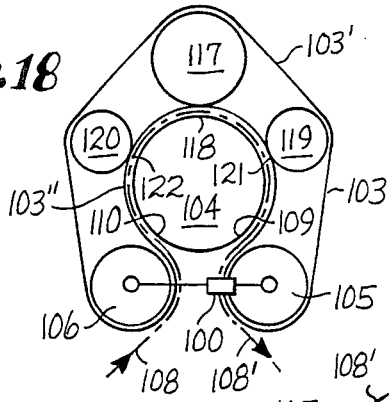

FIG. 18 illustrates a five roller assembly. Again, tensioning rollers 105 and 106 support the assembly. Idler nip rollers 117, 119 and 120 are fixed spatially with respect to central drum 104 except they may move radially to form nips 118, 121 and 122 with central drum 104. The angles between rollers are equal when the roller diameters are equal to avoid forces which are nonradial to central drum 104. The entry and exit angles of the outer belt course 103' with the radial axis of each idler nip roller are equal for each roller.

Figure 19:
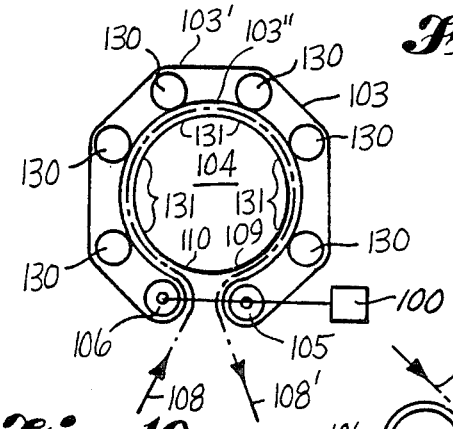

FIG. 19 illustrates an assembly having a multiplicity of idler nip rollers arranged about the central drum 104. The entering and exiting angles between each of the rollers and the belt are the same. Again, the angles between rollers are the same if the rollers are of the same diameter. Each of the rollers 130 move radially with respect to a radial axis of the central drum 104 to form nips 131 with the drum.

Figure 20:
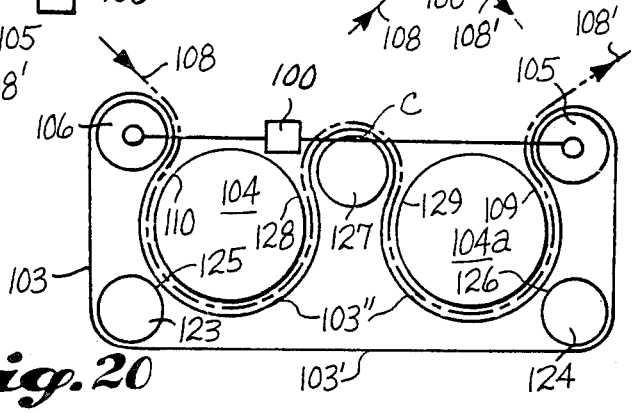

In FIG. 20 two central drums 104 and **104*a* are integrated with five rollers by employing two outer idler nip rollers 123 and 124, and an intermediate idler nip roller 127 between the two central drums 104 and 104*a*. The intermediate idler nip roller 127 is disposed within the body of the belt 103, and clasped and supported by a U-shaped bend C in the inner course 103" of the belt in the space between the central drums. All of the rollers form nips with the central drums—idler nip roller 123 forming nip 125 with drum 104, idler nip roller 124 forming nip 126 with drum 104*a*, intermediate idler nip roller forming nip 128 with drum 104 and 129 with drum 104*a*, tensioning roller 105 forming nip 109 with drum 104*a* and tensioning roller 106 forming nip 110 with drum 104**.

FIGS. 21–31 illustrate the total compressive forces on the central drum 104 and web 108 using various embodiments of the present invention. The numerals used in these figures are the same as those used in FIGS. 14–20.

Figure 21:
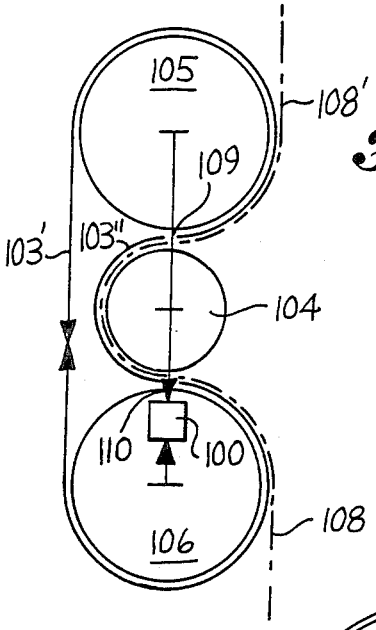
FIGS. 21–22 are diagrams similar to FIGS. 4–7 illustrating two embodiments of the present invention and the forces acting within these systems.

FIG. 21 discloses a system in which there is no tension on the belt because the tensioning rollers 105 and 106 are aligned on the center line of central drum 104 and form nips 109 and 110 with the central drum. The total compressive force due to the belt is zero and the total compressive force due to the nips is $\sqrt{T}$. This is a hypothetical limiting condition.

FIGS. 22–26 show various three-roller assemblies and demonstrate the change in total compressive forces on the central drum and web caused by changing the locations of the three rollers.

Figure 22:
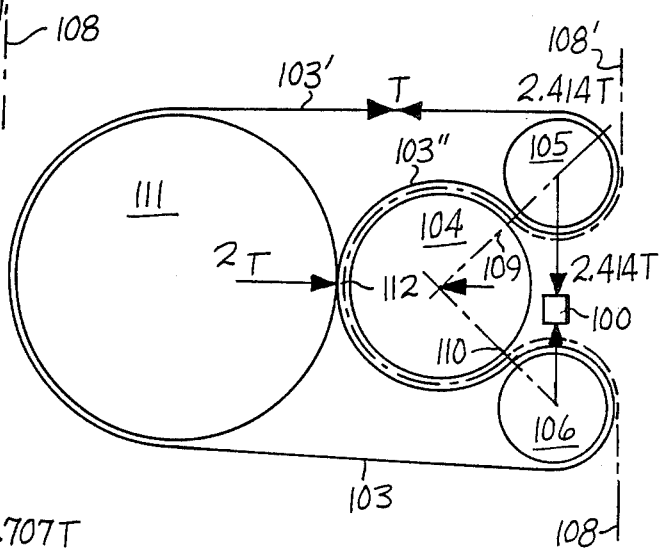
Figure 23:
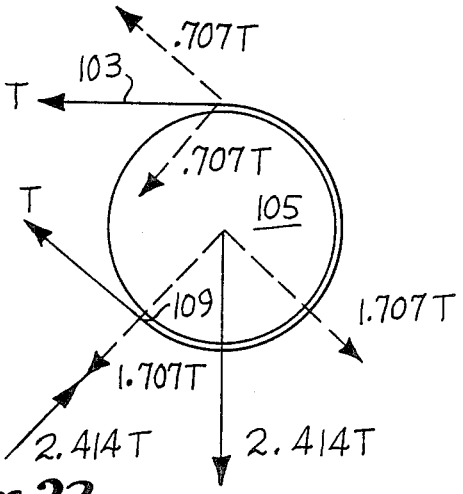
FIG. 23 is a vector analysis diagram of the forces acting on one of the tension rollers of the embodiment shown in FIG. 22.

In FIG. 22 the tensioning rolls 105 and 106 are 90° apart and the circumferential contact between the inner course 103" of belt 103 and the central drum 104 is 270° or 75% of the total surface. Thus, the compressive force due to uniform belt pressure on the drum is 4.7 T as it was in the earlier systems. The vector analysis of the forces on tensioning roller 105 is shown in FIG. 23. This shows that the force between the tensioning rollers 105 and 106 is 2.414 T in order to obtain a tension force of T in the belt. It also illustrates that the compressive force at the nip between the tensioning roller and the central drum 104 is 2.414 T also. There is also a compressive force of 2 T at the nip 112. This results in a total compressive force of 11.5 T. The diagram also illustrates that there are no forces passed to the frame from the central shafts of any of the rollers or the central drum.

Figure 24:
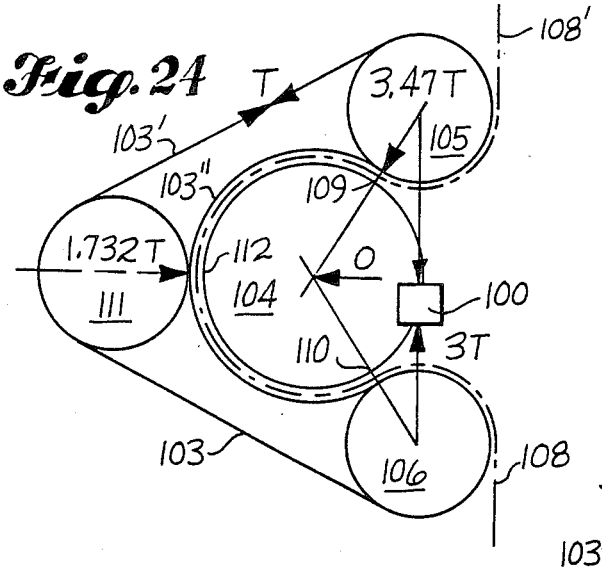
FIG. 24 is a diagram similar to FIG. 22 showing another embodiment of the present invention.
Figure 25:
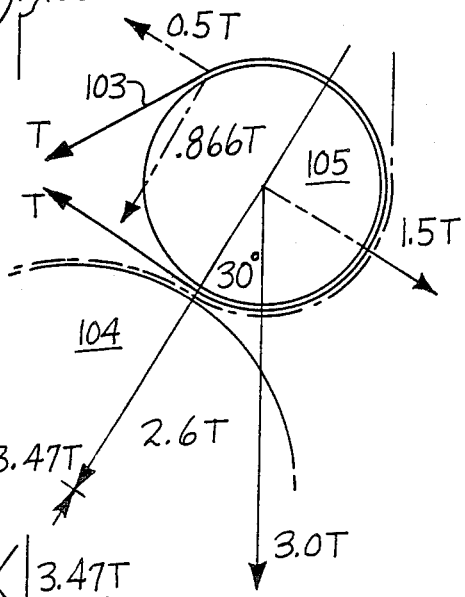
FIG. 25 is a vector analysis diagram showing the forces acting on one of the tension rollers of the embodiment of FIG. 24.

In FIG. 24 the two tensioning rollers 105 and 106 and idler nip roller 111 are spaced 120° apart. The forces acting on each of the tensioning rollers are shown in FIG. 25. It requires 3 T of force between tensioning rollers 105 and 106 in order to obtain a tension force of T in belt 103. The compressive force from belt 103 is 4.2 T from the 240° circumferential contact of central drum 104. The compressive force at the nip between each tensioning roller 105 or 106 and the central drum 104 is 3.47 T and the compressive force at nip 112 is 1.73 T. The total compressive forces acting on the web are 12.9 T. No force other than assembly weight is transferred to the frame or foundation of the assembly.

Figure 26:
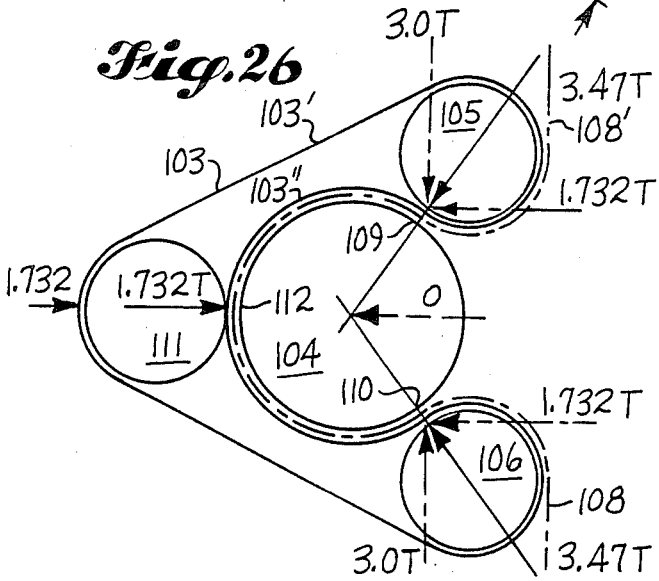
FIG. 26 is a vector analysis diagram illustrating the forces acting upon the central drum and rollers in the embodiment of FIG. 24.

FIG. 26 is a different vector diagram of the forces in the system shown in FIG. 24.

Figure 27:
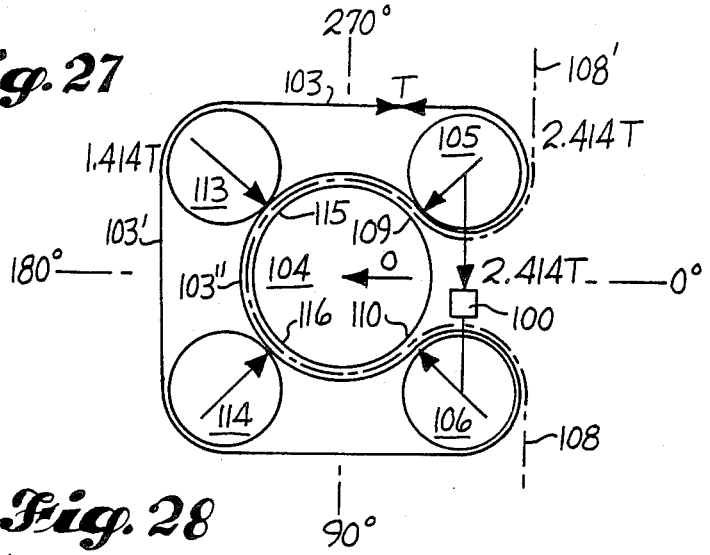
FIG. 27 is a diagram similar to FIGS. 21–22 showing another embodiment of the invention.

FIG. 27 is a vector analysis of a four roller system in which the rollers are spaced 90° apart. The compressive force due to the belt is the same as in FIG. 22 and the vector analysis of the tensioning rollers is the same as in FIG. 23. Each of the idler nip rollers 113 and 114 provides a total compressive force at the nip of 1.414 T. The total compressive forces acting on the web 108 are 12.3 T.

Figure 28:
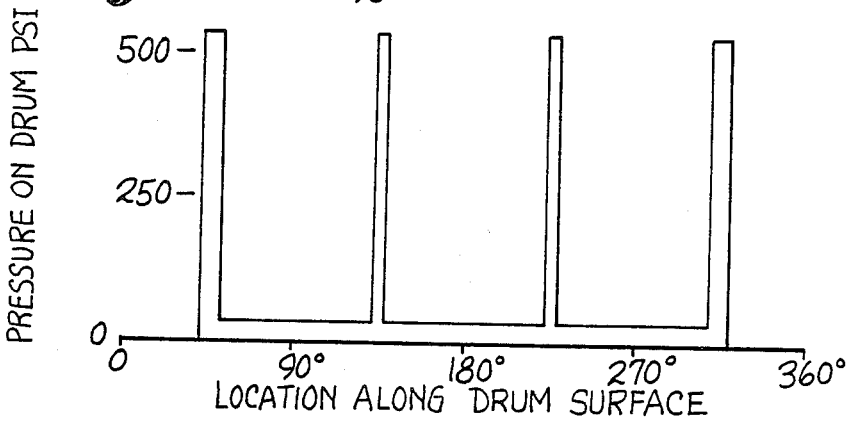
FIG. 28 is a diagram similar to FIG. 6 illustrating the compressive force pattern on the central drum of FIG. 27.

FIG. 28 is similar to FIG. 6 and illustrates the average pressures acting on the central drum 104 in FIG. 27. The parameters for FIG. 6 are also the parameters for FIG. 28. This also shows the additional force on the web because of the present roller, drum and belt configuration.

Figure 29:
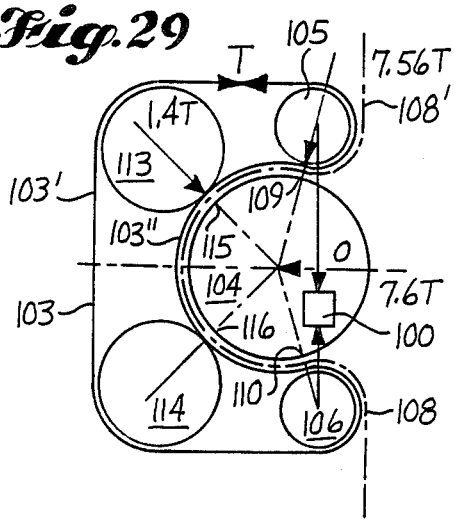
FIGS. 29–31 are diagrams similar to FIGS. 21–22 illustrating other embodiments of the invention.

FIG. 29 discloses another system for placing the four rollers. The only difference between FIG. 29 and FIG. 27 is that the two tensioning rollers 105 and 106 are placed 15° from the centerline of central drum 104 instead of 45° as in FIG. 27. This means that the compressive force due to the belt is slightly less because there is less circumferential contact between the web and the central drum 104, but the compressive force due to the tensioning roller nips is increased substantially to 7.56 T from the 2.414 T of FIG. 27. A greater amount of force is required to achieve a tension force of T in the belt. It increases from 2.414 T in FIG. 27 to 7.6 T in FIG. 29. The total compressive forces acting on web 108 in FIG. 29 are 21.62 T.

Figure 30:
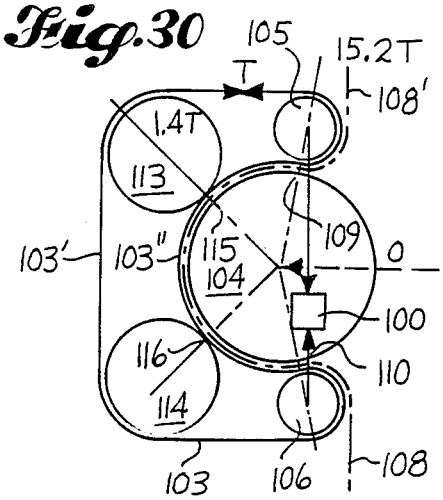

The principal difference between the system shown in FIG. 30 and that shown in FIG. 29 is that that tensioning rollers are placed 7.5° from the centerline of central drum 104, doubling the total compressive forces at the nips of the tensioning rollers 105 and 106. The total compressive forces acting on web 108 are now 36.6 T.

Figure 31:
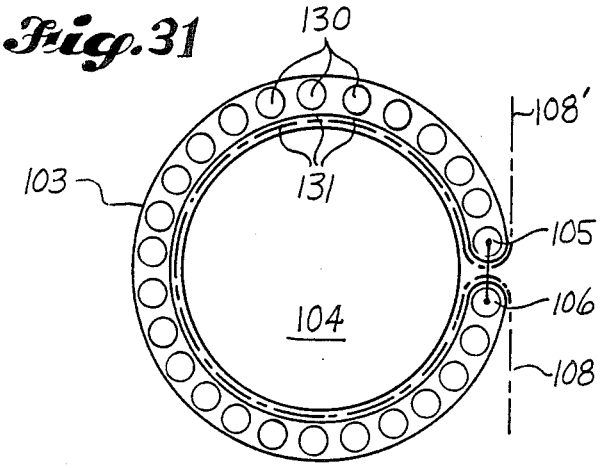

FIG. 31 illustrates a configuration in which there may be a large number of idler rollers 130. Again, as in the earlier illustration, the total compressive force due to the nips is equal to the total compressive force due to the belt and the total compressive force acting on the web 108 is approximately 12.56 T. This is a limiting condition and with FIG. 21 defines the spectrum of alternative configurations of the present invention.

Table 1 summarizes the total compressive forces for the earlier noted systems and for the present systems, and compares the total compressive forces that can be obtained with the different systems.

TABLE 1

| FIG. | Belt Contact % | Compressive Forces | Idler Rollers | Compressive Forces | Tension Rollers | Compressive Forces | Total Compressive Forces |
|---|---|---|---|---|---|---|---|
| 1 | 50 | 3.1 T | 0 | — | 2 | — | 3.1 T |
| 2 | 75 | 4.5 T | 0 | — | 2 | — | 4.5 T |
| 3 | 50 | 3.1 T | 1 | 2.0 T | 2 | — | 5.1 T |
| 4 | 50 | 3.1 T | 2 | 2.8 T | 2 | — | 5.9 T |
| 7 | 50 | 3.1 T | 3 | 2.8 T | 2 | — | 5.9 T |
| 8 | 50 | 3.1 T | 4 | 3.0 T | 2 | — | 6.1 T |
| 10 | 50 | 3.1 T | ∞ | 3.1 T | 2 | — | 6.3 T |
| 21 | 50 | — | 0 | — | 2 | ∞ T | ∞ T |
| 22 | 75 | 4.7 T | 1 | 2.0 T | 2 | 4.8 T | 11.5 T |
| 24 | 67 | 4.2 T | 1 | 1.7 T | 2 | 6.9 T | 12.8 T |
| 27 | 75 | 4.7 T | 2 | 2.8 T | 2 | 4.8 T | 12.3 T |
| 29 | 58 | 3.7 T | 2 | 2.8 T | 2 | 15.1 T | 21.6 T |
| 30 | 54 | 3.4 T | 2 | 2.8 T | 2 | 30.4 T | 36.6 T |
| 31 | 100 | 6.3 T | ∞ | 6.3 T | 2 | — | 12.6 T |

From this it can be seen that changing the tensioning rollers of the other systems into both tensioning and nip rollers in the present system in which these rollers are linked together and free to nip with the drum enables far greater forces to be exerted on the web while passing none of the tensioning or compressive forces to the frame or supporting structure.

Figure 32:
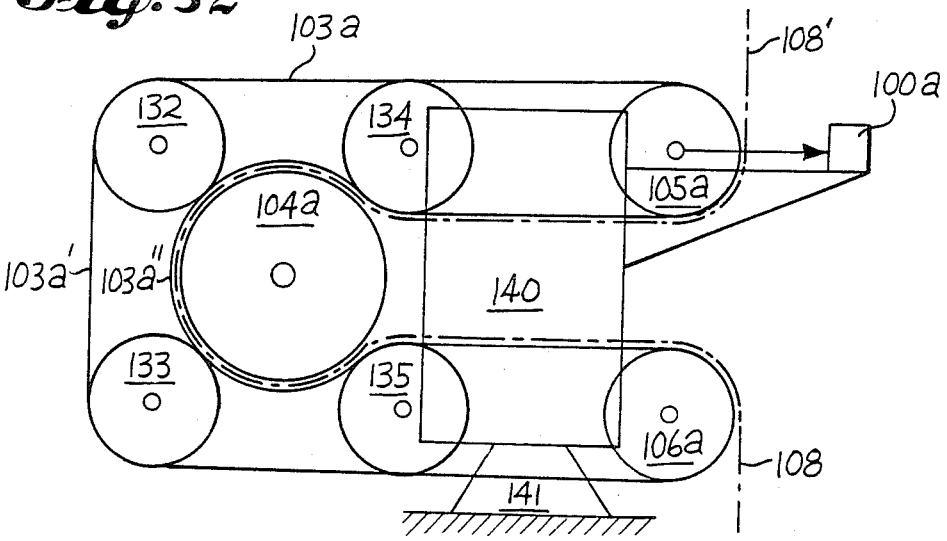
FIG. 32 is a schematic view of another embodiment of the invention.

FIG. 32 is a modification of the basic system. In this system there are four idler nip rollers 132, 133, 134 and 135. Two of the idler nip rollers 134 and 135 as well as the tensioning rollers **105*a* and 106*a* are mounted on a frame 140. The biasing means 100*a* is also mounted on the frame 140 and applies tension to tensioning roller 105*a*. The frame 140 is slidably mounted on a support structure 141. As tension is applied to tensioning roller 105*a*, the frame 140 will move toward central drum 107*a* Consequently, the tensioning forces are not transferred to the support structure 141**.

Figure 34:
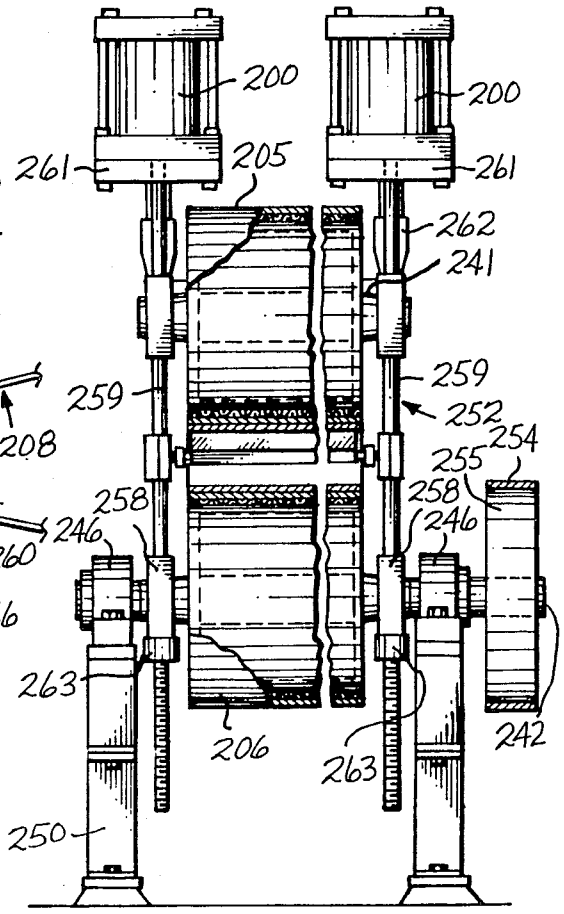
FIG. 34 is an end elevational view partially in cross section from the right hand end of FIG. 33.

FIGS. 33–35 illustrate a prototype apparatus. The press comprises an endless flexible belt 203 and a system of spaced upper and lower cylindrical rollers 205, 206, 213 and 214 for the belt. The belt and rollers are assembled on spaced parallel axes about a cylindrical central drum 204 and the assembly as a whole is cradled on a supporting structure 240. Each of the rollers 205, 206, 213 and 214 has a shaft 241, 242, 243 and 244. The shafts are trunnioned in and supported by sets of journal blocks 245, 246, 247 and 248 that are mounted on the structure 240 after the belt 203 is interwoven in and about the system of rollers 205, 206, 213 and 214 so that it can be used to compress a moving web 208 of paper making material passed between it and the central drum 204. Alternatively, frame members 249, 250 and 251 may be removed and the endless belt installed while the rollers are in position on the frame. In some installations, the rollers would be cantilevered and the belt may be placed over the rollers while the rollers are in position.

The journal block 246 and 248 for the shafts 242 and 244 of the lower rollers 206 and 214 are conventional pillow blocks which are secured fixedly to the structure 240. The journal blocks 245 for the shaft 241 of the upper roller 205 are carriage blocks which are engaged slidably on a frame 252 which is rotatably attached to the shaft 242 of the lower tension roller 206. The frame 252 is attached adjustably to the shaft 242 after the belt 203 is put in place, and is equipped with a pair of hydraulic cylinders 200 at the top thereof by which the upper tension roller 205 can be positioned adjustably with respect to the lower tension roller 206 to tension the belt 208.

The journal blocks 247 for the shaft 243 of the upper idler roller 213, are also conventional pillow blocks which are mounted on the upper ends of the arms 251. The arms 251 are pivotally mounted on the stanchion 253 at the rear of structure 240 so that the roller 213 can reciprocate with respect to the axis of the central drum 204 generally radially thereof, to make a nip.

When the press is put to use, the belt 203 is driven through an endless path by drive means (not shown), belt 254 (FIG. 35) and the sheave 255 on the right hand end of shaft 242 of the roller 206.

When the press is used to compress water from the web 208, a loop of permeable felt 256 may be interwoven in and about the system of rollers in a common path with that of the belt 203. The felt loop 256 is extended away from the run belt 203 at the rear of the structure, however, to enable it to be passed about a tightening and guiding roller 257.

The belt 203 is tensioned by using the upper tension roller 205 to bias the belt toward the lower tension roller 206. The tension frame 252 for the upper tension roller 205 comprises a pair of journal block 70 which are rotatably mounted on the shaft 242. Pairs of guide rods 259 extend through apertures 260 in journal blocks 258. The pairs of rods 259 are also equipped with header plates 261 at the tops thereof, and the cylinders 200 are mounted on the header plates 261. The carriage blocks 245 for the shaft 241 of the upper roller 205 are slidably guided on the respective pairs of rods 259, and are suspended from the cylinders 200 by means of individual drive connections 262. Accordingly, when the tension rollers 205 and 206 are positioned within the belt 203 and the rods 259 are secured to the bottoms of the journal blocks 258 by the nuts 263, the cylinders 200 can be used to bias roller 205 toward roller 206 to tension the belt 203 about the system of rollers.

A doctor blade 264 is pivotally mounted on carriage blocks 265 which are adjustably positioned on rods 259. The doctor blade 264 ensures the release of the paper web 208 from central drum 204.

The belt 203 and felt 256 configuration E has an outer U-shaped course E′ and an inner U-shaped course E″ which meet in loop ends L. The tensioning rollers 205 and 206 are enclosed within the bodies of belt 203 and felt 256 and disposed at the loop ends L. Idler rollers 243 and 244 are also enclosed within the bodies of belt 203 and felt 256 and disposed within the outer course E′ of the belt and felt configuration. The central drum is interposed in the space defined by the rollers 205, 206, 243 and 244 and is engaged with the outer face of inner course E′ of the belt and felt configuration so that the inner course E′ of the belt and felt configuration is bent about the central drum 204 in a U-shaped configuration B. The idler rollers 213 and 214 are interposed between the inner face of outer course E′ of the belt and felt configuration and the bight B′ of the inner course E″; to maintain the inner faces of courses E′ and E″ in spaced relationship to one another.

The web 208 to be processed is passed between the roller 206 and central drum 204, and is guided about the central drum 204 between the felt 256 and the periphery of the central drum 204. Roller 205 is driven relatively downward on the frame 252 by the cylinders 200 to engage the rollers 205 and 206 with the legs B″ of the U-shaped configuration B. The belt and felt members are drawn taut about the central drum 204 at the bight B′ of the U, and the belt 205 and felt 256 are brought into tension. As roller 205 moves downwardly it rotates on the frame 252 about the shaft 242 of roller 206, and the rollers 205, 206, 213 and 214 nip the belt 203, felt 256 and web 208 between their outer surfaces and that of the central drum 204, respectively, the rollers 205 and 206 nipping with central drum 204 at 209 and 210 and the rollers 213 and 214 nipping with central drum 204 at 215 and 216. The tension enables the roller 206 to drive the belt 204, felt 256 and web 208 about the central drum 204. The central drum 204 is clasped by the belt between the legs B″ and the bight B′ of the U-shaped configuration B, and between the nips 209, 210, 215 and 216 of the rollers 205, 206, 213 and 214 and is supported in the assembly independently of the structure 240. Its axis of rotation is detached from the structure 240 and it is free to move to nip with rollers 205 and 213 while continuing to nip with rollers 206 and 214. Roller 214 moves generally radially to nip with the central drum 204. The overall effect is to enable the web to be passed rapidly about the central drum 204, while it is subjected to high levels of compression between the belt 203 and the central drum 204, as well as within the nips 209, 210, 215 and 216.

The combined total forces on central drum 204 from the belt pressure of the U-shaped configuration B and the nip forces of the nips 209, 210, 215 and 216 are inherently balanced so there is no resultant force transmitted to the structure 240 due to belt tension and there is no axial bending moment imposed on central drum 204 due to belt tension. The principle force transferred to the structure 240 is the weight of the assembly which is carried by rollers 206 and 214 on which the central drum 204 rests.

As the water is squeezed from the web, it is collected in the felt 256 and removed from the felt by suction device 266 or passes through the felt and the belt.

Axial movement of the central drum 204 is limited by a pair of guide rollers 267 positioned at its ends on a pair of mountings 268 upstanding from the structure 240. A belt guide 269 is provided at the front of the stanchion 253.

When it is desired to apply both heat and compression to the web, the heat may be fluxed into the web through the central drum.

FIGS. 36–59 illustrate the flexibility to perform this function created by the present press design.

Figure 36:
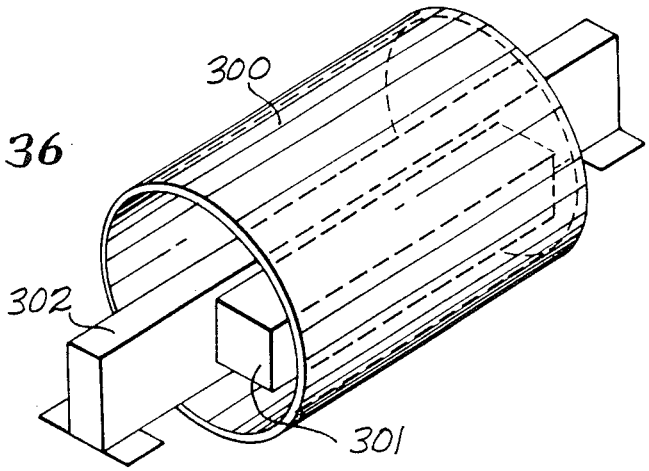
FIG. 36 is a schematic view of an internally heated drum.

FIG. 36 illustrates schematically a simple central heating drum. The central drum 300 is a plain, single-wall cylinder which is open ended and has no shaft. A heat source 301 is mounted within the central drum 300 on a stationary mounting beam 302. The heating source 301 may be a combustion burner or an electrical heating source.

The absence of direct axial stress in the heated drum due to the absence of imposed axial bending moments creates the opportunity for a further improvement in the capability of the drum to handle higher heat flux through the drum wall. Circumferential grooves or slits can be utilized to reduce stress levels in the drum wall created by the temperature differential associated with heat flux permitting a higher $\Delta T$ for a given wall or an increased wall thickness for a given $\Delta T$.

FIGS. 37–44 show various methods of accomplishing this. Each of these is shown in connection with the drum 300 of FIG. 36.

Figure 37:
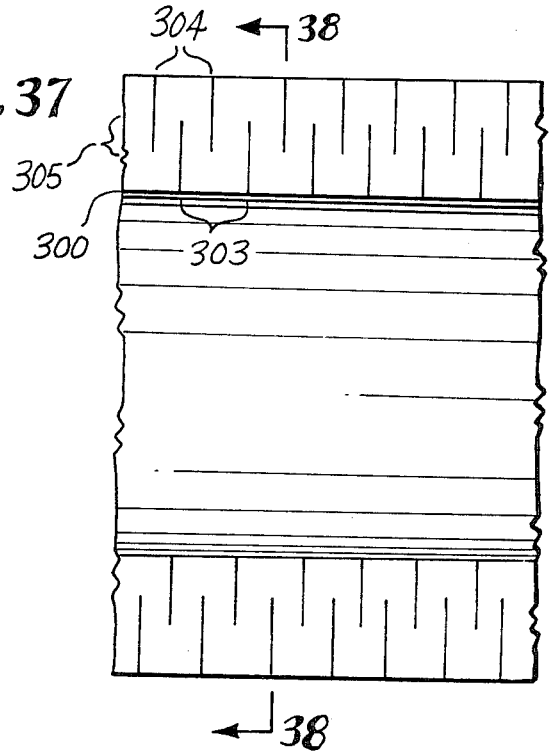
FIG. 37 is a portion of a stress relieved drum shell.
Figure 38:
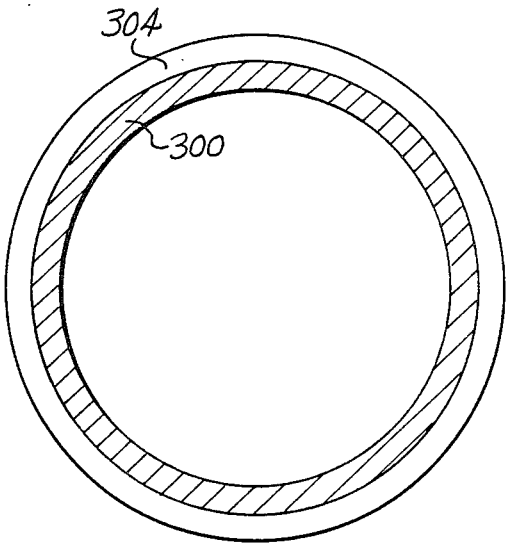
FIG. 38 is a cross-sectional view taken along line 38–38 of FIG. 37.

FIGS. 37 and 38 illustrate a drum or drum shell in which there are circumferential grooves in both the inner and outer surfaces of the wall. The inner grooves 303 are offset from the outer grooves 304 and they may overlap in the center of the wall at 305. The outer grooves 304 may be filled with a resilient material having less strength than the drum material. The material would be a softer metal and would allow the drum to present a smooth face to the web.

FIGS. 39 and 40 illustrate a drum in which there are only inner circumferential grooves 303. These grooves may extend as near the outer surface as possible. The only requirement is that there be enough material between the groove and outer drum surface to hold the drum together.

FIGS. 41 and 42 illustrate another modification of the design shown in FIGS. 39 and 40. In this the wall sections 310 between the grooves 303 are tapered on their inner ends 311 to provide greater heat transfer surface. These inner ends 311 are grooved at 312 to reduce stress.

FIGS. 43 and 44 illustrate another modification of the structure shown in FIGS. 41 and 42. In this one the entire wall of groove 303 is tapered so that there is less material in wall section 310 and greater heat transfer surface. The sections 310 are also grooved at 312 to reduce stress.

FIGS. 45–57 illustrate novel means of using circulating fluid such as steam as a heat source for the high rates of heat flux desired. Again, the lack of axial bending moment facilitates these constructions. The central drum 350 comprises an elongated, hollow cylindrical drum 351 having a thin, hollow cylindrical outer concentric shell 352 spaced apart radially of the drum 351 to form a shallow annulus 353 therebetween. The shell 352 is secured to the drum by a system of radial connections 354 therebetween, which are arrayed about the drum in the annulus to provide external load bearing support for the shell over the entire area of the annulus as well as the capacity to retain the shell against internal pressure in the annulus. The connections 354 are spaced apart from one another to subdivide the annulus into a multiplicity of fluid flow passages 355 which extend throughout the annulus generally axially of the drum.

The connections may take the form of septa-like members 356 (FIGS. 48, 49, 50 and 51) which extend axially of the drum to form dividers between the passages; or they may take the form of spaced spoke-like members 357 (FIGS. 45–47) which are arrayed in rows that extend axially of the drum to form discontinuous dividers between the passages.

Figure 45:
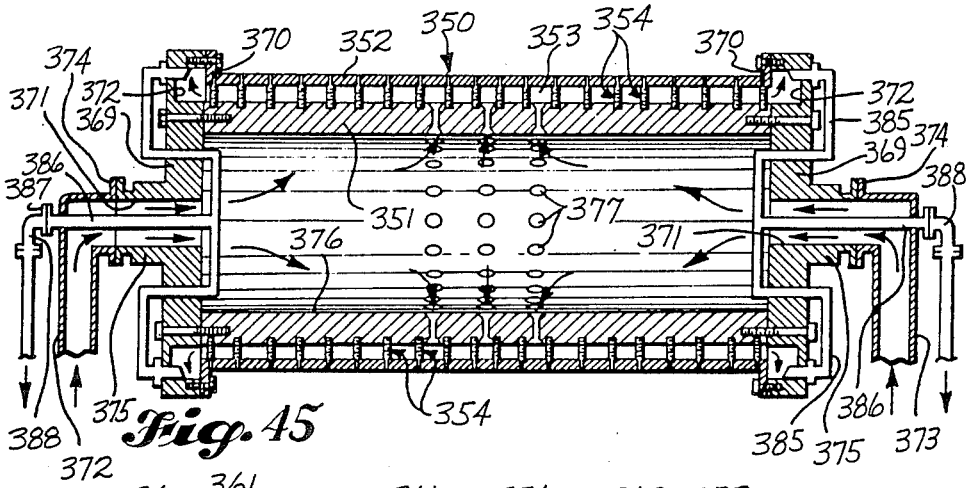
FIG. 45 is a cross-sectional view of a heated drum for use in any of the foregoing assemblies.
Figure 46:
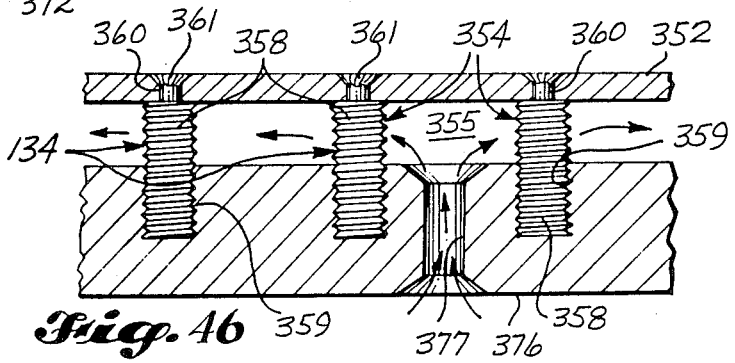
FIG. 46 is an enlarged longitudinal cross-sectional view of a portion of the annulus in the heated drum of FIG. 45.
Figure 47:
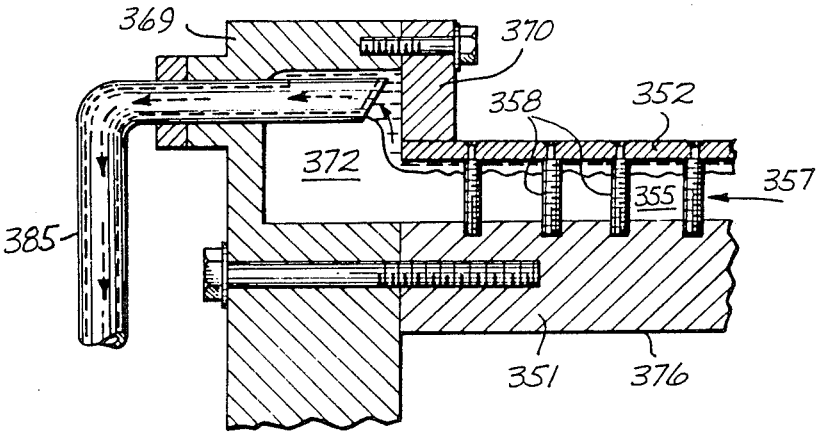

For example, in FIGS. 45–47, the connections 357 take the form of headless capscrews 358 which are arrayed in spaced axially extending rows and screwed into equal numbers and rows of threaded sockets 359 in the outer periphery of the drum 351, so as to upstand radially therefrom. The shell 352 has openings 360 therein corresponding to the number and sites of the capscrews, and is anchored to the tops of the screws by similar numbers and rows of machine screws 361 which are threaded into the tops of the capscrews and countersunk into the openings of the shell.

Figure 48:
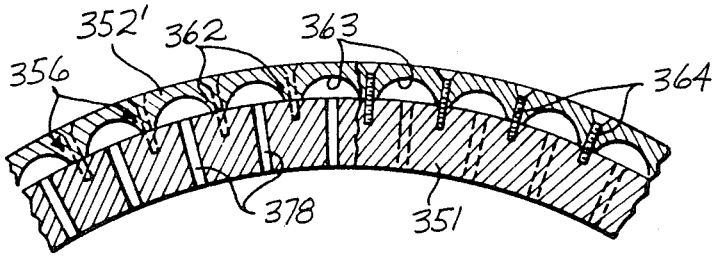
FIG. 48 is a transverse cross-sectional view of part of the annulus in an alternative form of fluid heated drum such as a steam heated drum.

In FIG. 48, the connections 356 take the form of ribs 362 which are formed between symmetrically spaced, axially extending grooves 363 in the inner periphery of the shell 352', the number of which is adapted so that there is a series of such grooves extending about the full circumference of the shell at the inner periphery thereof. The shell 352' is sized to engage tightly about the outer periphery of the drum 351, at the inner peripheries of the ribs 362, and the ribs are anchored to the drum by sets of machine screws 364 which are threaded through the ribs into the outer periphery of the drum and countersunk into corresponding openings in the shell.

Figure 49:
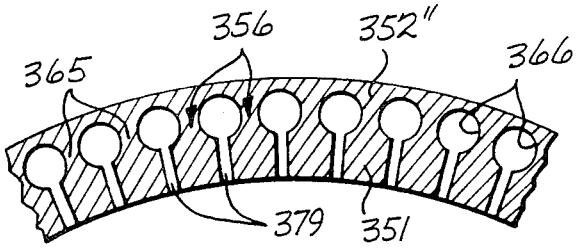
FIG. 49 is a view similar to FIG. 48 of another version of a fluid heated drum.

In FIG. 49, the connections 356 take the form of webs 365 which are formed between symmetrically angularly spaced, axially extending bores 366 in the outer peripheral portion of the drum itself, the number of which is adapted so that there is a series of such bores extending about the full circumference of the drum adjacent the outer periphery thereof. The bores 366 are spaced apart from the outer periphery of the drum, however, to form the shell 352 therebetween, as seen in FIG. 49.

Figure 50:
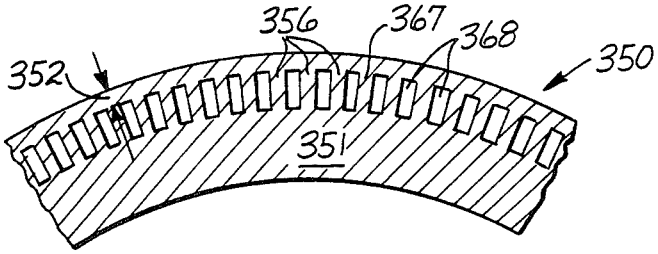
FIG. 50 is a view similar to FIG. 48 of a preferred version of a fluid heated drum.
Figure 51:
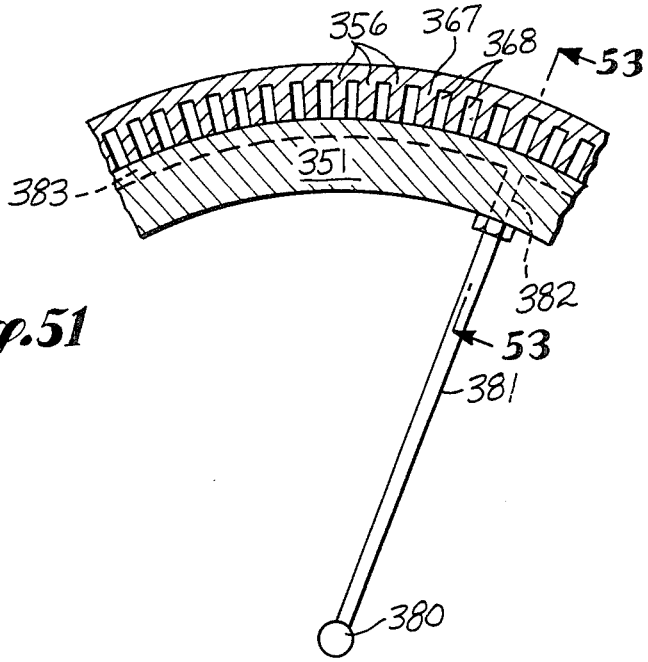
FIG. 51 is a view similar similar to FIG. 48 illustrating the preferred construction of the drum of FIG. 50.

In FIGS. 50 and 51 the connections 356 take the form of webs 367 which are formed between symmetrically angularly spaced axially extending rectangular bores 368. The radial height of the bores 368 is greater than the peripheral width. This increases the steam condensing area, enhances the condensing rate by incorporating the extended radial surface so the centrifugal force aids condensate removal from the condensing surface. The metal stress from internal steam pressure is reduced because of the small cross section of the passages. The maximum condensing area is near the surface where it is needed to reduce $\Delta T$ and increase the surface temperature. The thickness of shell 352, the distance between the outer wall of the apertures 368 and the outer periphery of the shell, must be adequate for the internal pressure of the steam and the imposed mechanical loads from the nip rolls and belt. The total thickness must also withstand this mechanical loading and keep the total stress within the allowable stress for the material of construction.

The shell and drum may be monolithic as shown in FIG. 50 or separate as shown in FIG. 51. The usual length of a heating drum will normally dictate that the construction of FIG. 51 will be used because it is easier to machine. The joint between the outer shell 352'''' and the drum 351 will be fusion joined as with silver brazing. In both constructions the thickness of the webs 367 will be great enough to withstand the mechanical loads placed on the central drum.

In each of these constructions, the total heat transfer surface of the axially oriented passages within a defined radial distance from the outer perimeter of the shell should be greater than the outer perimeter surface of the shell. The defined radial distance in inches is $1/5\sqrt{k}$ where k is the thermal conductivity of the material of construction of the outer shell, expessed in BTU per hour per square foot per unit temperature gradient, °F./foot. This value is approximately 25 for steel and 200 for copper. The axial heat transfer area of the axial passage should be significantly greater than the outer perimeter surface of the shell, e.g., 200% or more.

Figure 52:
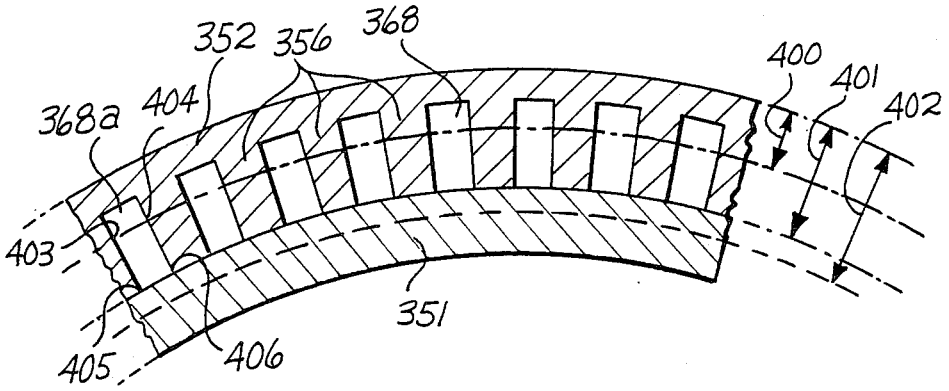
FIG. 52 is a diagram showing the placement and size of the passageways.

This is illustrated in FIG. 52. The structure of FIG. 50 is again shown. Three different radial distances are shown. These are 400, 401 and 402. Each is equal to $1/5\sqrt{k}$ inches. They are different because they represent the radial distance for three different materials of construction. When the radial distance is 400, then the peripheral surface of the axial passages 368 within that distance, the surface area between lines 403 and 404, should be greater than the outer surface of the shell. When the radial distance is 401, then the peripheral surface of axial passage 368 within that distance, the surface area between lines 405 and 406, should be greater than the outer surface area of the shell. When the axial distance is 402, then the total surface area of the axial passage should be greater than the outer surface area of the shell.

Figure 53:
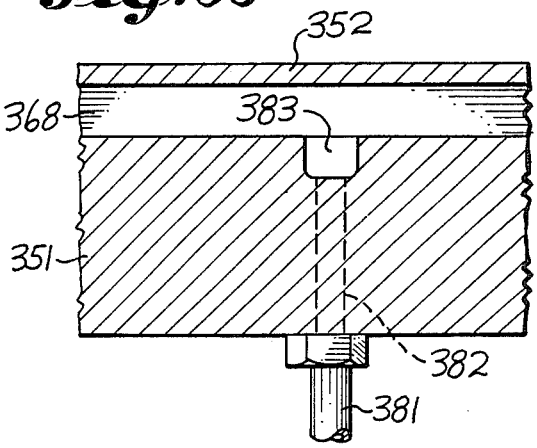
FIG. 53 is an axial cross sectional view showing a typical construction of a fluid supply line to the distribution channel.
Figure 54:
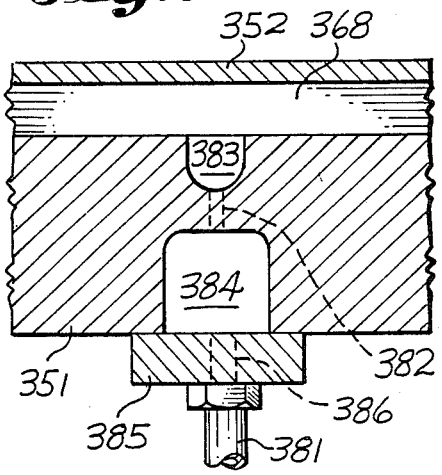
FIG. 54 is an axial cross sectional view of an optional intermediate distribution channel.

FIGS. 51 and 53–54 illustrate another method of fluid distribution. The openings 371 do not egress into the hollow 376 of the drum but instead join with central axial pipe 380 which feed a series of radial pipes 381 and radial apertures 382 in the drum. Circumferential passages 383 in the outer face of the drum provide access to the apertures 368.

FIG. 54 illustrates a version in which there is a collection chamber 384 on the interior wall of the drum. The inner end of chamber 384 is capped by member 385. An aperture 386 in member 385 provides a passage between pipe 381 and chamber 384. Aperture 382 connects chamber 384 and passage 383.

FIG. 45 also shows the removal of liquid or condensate from the drum. The ends of the central drum 350 are defined by a pair of end plates 369 which abut the ends of the shell and drum when they are bolted to the drum 351 and the annular plate 370 of shell 352 as shown. The plates have central axial openings 371 and annular grooves 372 about the inside faces of the outer peripheral portions thereof. The grooves 372 are diametrically sized to register with the ends of the annulus 353, and serve as collection chambers for the steam or other heat transmission fluid used to service the roller. The fluid is supplied to the drum by one or two ducts 373 which are slip jointed at 374 to the neck 375 of the face plate 369. The duct 373 is connected to the hollow 376 of the drum through the openings 371 in the plates 369. The fluid enters the hollow of the drum and discharges into the annulus 353 through a series of angularly spaced apertures 377 in the body of the drum. The apertures are formed about the central portion of the drum. In the embodiment of FIG. 48, there is always one or more apertures 378 for each passage. In FIG. 49, the bores 366 are serviced by apertures 379 in the inner peripheral portion of the drum, there again being at least one aperture for each passage.

In the annulus 353, the steam or other heat transmission fluid moves lengthwise of the passages 355 toward the chambers 372. The fluid is removed from the chambers by a siphon or bleeder arrangement and ducted out of the drum through radial pipes 385, axial pipe 386, rotary joint 387 and exterior pipe 388 in a known manner.

Figure 55:
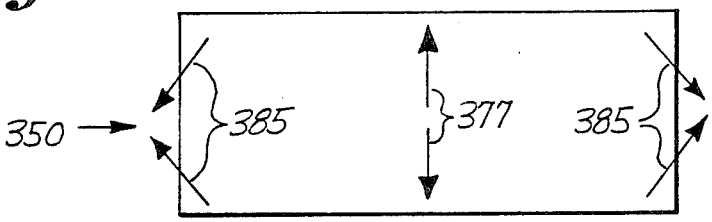
Figure 56:
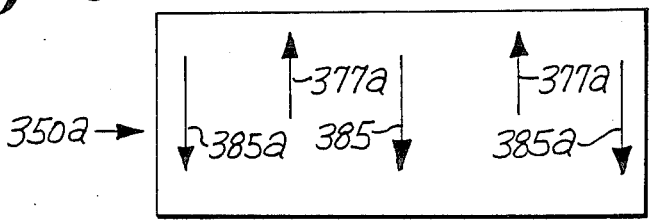
Figure 57:
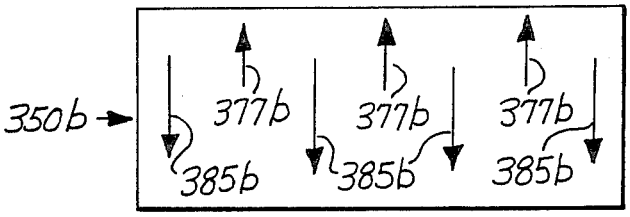

The number of entry ports 377 and exit ports 385 will depend upon the length of the drum and the amount of condensation within the drum. FIGS. 55–57 are diagrams taken along the axis of the drum showing multiple entry and exit points in the drum depending upon its width or the amount of condensate. FIG. 55 is a diagram of the configuration shown in FIG. 45, and the reference numerals for FIG. 45 are used. There are central inlet ports 377 and end outlet ports 385. FIG. 56 illustrates two sets of inlet ports, and two end and one central set of exit ports. FIG. 58 illustrates three sets of inlet ports, and two end exit ports and two intermediate sets of exit ports between the inlet port sets. Although the reference numerals from FIG. 45 have been used, the inlet and exit port units may be any type.

FIG. 57 shows the exit aperture such as one of the exit ports 385, in relationship to a number of the axial passages, such as passage 368, in the drum.

The induced thermal stress in a thickness of metal is proportionate to the temperature differential ($\Delta T$) across it which in turn is proportional to the heat flow rate. The faster drying rates made possible by the present invention require a short heat flow path through the outer shell 352 of the drum. At the necessary high heat flux rates, a high $\Delta T$ will be of concern primarily because of metal stress. However, in the case of steam heating which has economic advantages but distinct temperature limitations, a high $\Delta T$ may also be a process parameter concern, that is, for a given steam pressure and temperature, increased $\Delta T$ reduces the available temperature of the outer drum surface thereby reducing the potential drying rate. For conventional heat transfer metals such as steel and copper, certainly a $\Delta T$ of 5° F. is acceptable. A $\Delta T$ of 20° F. poses some concern because of heat stress and process concerns, and a $\Delta T$ of 40° F. may be unacceptable. FIG. 58 is an illustration of the relationship of shell thickness to heat flux for steel, bronze, aluminum and copper.

The heat flux from the annulus 353 to the web is also a function of the condensing rate of the steam or other heat transfer fluid in the annulus, and the rate of the steam or other heat transfer fluid in the annulus, and the rate of heat transfer to the web from the outer surface of the shell. The latter is enhanced by the high contact pressures of the web on the outer surface of the shell. The former is enhanced by the large amount of condensing surface provided in the annulus as well as the novel arrangement which maximizes $\Delta T$ available to cause condensation rather than use it in heat flow through the shell.

Stress due to the internal steam pressure can be reduced to a negligible level such as 100 psi or less, by reducing the diameter of the passages to a small figure, such as ½ inch or less. Nip loads upward of 1,000 pli or more can be borne by the system of radial connections 356 or 357 between the drum 351 and the shell, where the maximum diameter of the passages 355 between connections is kept low in relation to the thickness of the shell.

The ring crushing stresses induced by the nip loads and the belt contact pressure, are absorbed in the heavy body of the drum 351, and as indicated earlier, the drum need only be sized and constructed to withstand these loads, there being no imposed axial bending moment on the drum 350.

Operation of the present invention has been demonstrated on a pilot machine-paper dryer equipped with a 24 inch diameter heated drum. Operating speeds of 25% to 40% of commercial speeds were attained, depending on grade of paper, indicating that commercial speeds can be attained with a reasonable sized first drum of 5 ft. to 8 ft. diameter. Water removal rates up to 150 lb of water per square foot of drum per hour were attained, indicating that commercial speeds could be attained using a total lineal circumferential length of dryer drum of 50 ft. versus the 1,500 ft. in present commercial practice.

I claim:

1. A drum and belt-type press for compressing a moving web or mat which comprises:

(a) a supporting frame for a drum, belt tensioning rolls, and belt tensioning means;

(b) a pair of spaced apart first and second cylindrical belt tensioning rolls having essentially parallel axes of rotation;

(c) a central drum adjacent said tensioning rolls, said drum having an axis of rotation essentially parallel to the axis of rotation of the rolls;

(d) an endless flexible belt having an inner generally U-shaped course and an outer generally U-shaped course, the inner and outer courses meeting in loops which wrap around the tensioning rolls, the tensioning rolls each being contained within the body of the belt and the drum being outside the body of the belt, the inner course of the belt being wrapped around more than half the circumference of the central drum, the tensioning rolls and drum being sized so that the inner and outer courses of the belt are spaced apart, each tensioning roll and any other rolls within the belt making nip contact with the drum through the interposed belt so that the total compressive forces of the belt and nips on the central drum are balanced and the summation of forces about the drum axis is essentially zero;

(e) drive means for moving the belt through its endless path, so that a web or mat may be compressed by interposing it between the moving belt and drum, (f) tensioning means acting on the tensioning rolls to translate them relatively toward or away from each other to control belt tension while maintaining nip contact, and (g) the tensioning rolls being mounted on the supporting frame the drum being free floating with respect to the tensioning rolls for relative radial movement in response to tensioning adjustments, and the press is structured to maintain nip contacts without transmitting significant belt tensioning forces to the supporting frame or significant axial bending forces to the drum.

2. The press of claim 1 in which the axes of the tensioning rolls lie in a common plane.

3. The press of claim 2 in which one of the tensioning rolls is in fixed position on the frame and the other tensioning roll is mounted so as to be movably translatable by the tensioning means toward or away from the fixed roll.

4. The press of claim 2 in which both of the tensioning rolls are mounted on the supporting frame so as to be movably translatable toward or away from each other whereby the centerline of the central drum normal to said common plane is stationary.

5. The press of claim 2 in which the common plane of the axes of the tensioning rolls lies generally horizontal and the central drum is entirely above said common plane and is supported by the tensioning rolls.

6. The press of claim 1 in which the belt and tensioning rolls are structured to generate radial compressive forces on the drum at least eleven times greater than the belt tension force.

7. The press of claim 1 in which the central drum has an outer shell with a plurality of apertures extending circumferentially around and along the axis of the outer shell to convey fluid to or from a web on the drum.

8. The press of claim 1 which further comprises at least one idler roll enclosed within the flexible belt body between the first and second tensioning rolls, the idler roll or rolls being radially moveable by the outer course of the belt and forming nips with the central drum through the interposing belt when said belt is in tension, the belt, idler, and tensioning rolls all being in a balanced force relationship with the drum.

9. The press of claim 8 in which the central drum has a diameter greater than that of the tensioning and idler rolls.

10. The press of claim 8 in which the outer course of the belt forms equal approach and departure angles with the radial line passing through the center of the central drum and each of the idler rolls.

11. The press of claim 2 in which the central drum is a hollow, open ended metallic cylinder.

12. The press of claim 11 which further comprises heating means within the cylinder.

13. The press of claim 11 in which said cylinder has a wall containing a plurality of circumferential stress relieving grooves.

14. The press of claim 13 in which the grooves are on the inner face of the wall so as to define inner circumferential wall sections.

15. The press of claim 14 in which each of the wall sections has a tapered interior section.

16. The press of claim 15 in which the tapered interior sections have a plurality of axial stress relieving grooves.

17. The press of claim 14 in which the wall sections are tapered inwardly.

18. The press of claim 17 in which the tapered interior sections have a plurality of axial stress relieving grooves.

19. The press of claim 14 in which the cylinder has a plurality of circumferential stress releiving grooves on the outer face of the wall, said outer grooves being offset from the inner grooves.

20. The press of claim 19 in which the outer grooves are filled with a resilient material having less strength than the drum metal.

21. The press of claim 20 in which the resilient material is a softer metal than the metal of the drum wall.

* * * * *